US008017005B2

(12) United States Patent
Ringenbach et al.

(10) Patent No.: US 8,017,005 B2
(45) Date of Patent: Sep. 13, 2011

(54) ADJUSTABLE, CONFIGURABLE STORM INLET FILTER

(76) Inventors: James A. Ringenbach, Naperville, IL (US); James T. Ringenbach, Elk Grove Village, IL (US)

( * ) Notice: Subject to any disclaimer, the term of this patent is extended or adjusted under 35 U.S.C. 154(b) by 0 days.

(21) Appl. No.: 12/686,914

(22) Filed: Jan. 13, 2010

(65) Prior Publication Data

US 2010/0108839 A1 May 6, 2010

Related U.S. Application Data

(62) Division of application No. 11/926,676, filed on Oct. 29, 2007, now Pat. No. 7,670,483.

(51) Int. Cl.
*E03F 5/06* (2006.01)

(52) U.S. Cl. ..... 210/163; 210/164; 210/473; 210/474; 404/4

(58) Field of Classification Search ..... 248/309.1, 248/278.1, 317, 318, 323, 339, 225.11, 205.1, 248/95; 210/747, 164, 232, 153, 163, 474; 404/2, 3, 4, 5
See application file for complete search history.

(56) References Cited

U.S. PATENT DOCUMENTS

| | | | |
|---|---|---|---|
| 5,297,367 | A | 3/1994 | Sainz |
| 5,643,445 | A | 7/1997 | Billias et al. |
| 5,849,198 | A | 12/1998 | Sharpless |
| 6,004,457 | A | 12/1999 | Singleton |
| 6,010,622 | A | 1/2000 | Chinn et al. |
| 6,045,691 | A | 4/2000 | McDermott |
| 6,086,758 | A | 7/2000 | Schilling et al. |
| 6,093,314 | A | 7/2000 | Wilson et al. |
| 6,106,707 | A | 8/2000 | Morris et al. |
| 6,149,803 | A | 11/2000 | DiLoreto, Jr. et al. |
| 6,178,565 | B1 | 1/2001 | Franco |
| 6,214,216 | B1 | 4/2001 | Isaacson |
| 6,254,770 | B1 | 7/2001 | Remon |
| 6,270,662 | B1 | 8/2001 | Gibson et al. |
| 6,270,663 | B1 | 8/2001 | Happel |
| 6,274,036 | B1 | 8/2001 | Ellis |
| 6,287,459 | B1 | 9/2001 | Williamson |
| 6,294,095 | B1 * | 9/2001 | Lewis ..... 210/747 |
| 6,517,709 | B1 | 2/2003 | Cardwell et al. |

(Continued)

FOREIGN PATENT DOCUMENTS

| | | |
|---|---|---|
| JP | 11222915 | 8/1999 |

*Primary Examiner* — Terrell Mckinnn
*Assistant Examiner* — Todd M. Epps
(74) *Attorney, Agent, or Firm* — McAndrews, Held & Malloy, Ltd.

(57) ABSTRACT

System and apparatus for filtering drainage which includes a configurable and adjustable rigid frame, hanger support structures adapted to contact a surface of a drainage structure, and a sediment bag. The frame may be adjusted or configured by modifying the location of connecting fasteners and/or by altering the orientation of frame components. Additional embodiments provide for an overflow gap comprising a vertical distance between an above grade surface of a drainage structure and the rigid frame, wherein the overflow gap is capable of allowing runoff to bypass the sediment bag when the sediment bag is obstructed. A configurable lifting tool device adapted to lift inlet grates and inlet filter devices includes a lifting bar, a plurality of connectors, a plurality of lifting arms, and a plurality of lifting hooks adapted to contact a grate and/or an inlet filter device lifting bar.

18 Claims, 20 Drawing Sheets

U.S. PATENT DOCUMENTS 6,521,122 B1 2/2003 Elliot et al.
6,531,059 B1 3/2003 Morris et al.
6,537,446 B1 3/2003 Sanguinetti
6,551,023 B2 4/2003 Allard
6,609,852 B2 8/2003 Wimberger
6,623,633 B2 * 9/2003 McDermott et al. ..... 210/164
6,709,579 B1 3/2004 Singleton et al.
6,726,402 B1 4/2004 Martinez
6,805,804 B2 10/2004 Page
6,808,623 B2 10/2004 Harris et al.
6,872,029 B2 * 3/2005 Allard et al. ..... 405/36
6,976,808 B2 12/2005 Allard
6,998,039 B2 2/2006 Harris et al.
7,052,207 B1 5/2006 Wimberger
7,070,691 B2 7/2006 Lindemulder
7,074,326 B2 7/2006 Singleton
7,112,274 B1 9/2006 Sanguinetti
7,156,987 B1 1/2007 Sanguinetti
7,160,048 B1 1/2007 Fattori et al.
7,201,843 B2 4/2007 Sasaki et al.
7,234,894 B1 6/2007 Flury
7,670,483 B2 * 3/2010 Ringenbach et al. ..... 210/163
2002/0130083 A1 9/2002 Middleton et al.
2003/0136717 A1 7/2003 Tseng
2004/0011731 A1 1/2004 Sanguinetti
2004/0094461 A1 5/2004 Sharpless
2004/0173513 A1 9/2004 Nino
2006/0054562 A1 3/2006 Peters et al.
2008/0023382 A1 1/2008 Longo et al.

* cited by examiner

ADJUSTABLE, CONFIGURABLE STORM INLET FILTER

RELATED APPLICATIONS

This application is a divisional of U.S. patent application Ser. No. 11/926,676 filed Oct. 29, 2007, now U.S. Pat. No. 7,670,483, entitled "ADJUSTABLE, CONFIGURABLE STORM INLET FILTER" which application is hereby incorporated by reference herein in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Water pollution degrades surface waters making them unsafe for drinking, fishing, swimming, and other activities. As authorized by the Clean Water Act, the National Pollutant Discharge Elimination System (NPDES) permit program controls water pollution by regulating point sources that discharge pollutants into waters of the United States. Point sources are discrete conveyances such as pipes or man-made ditches. Individual homes that are connected to a municipal system, use a septic system, or do not have a surface discharge do not need an NPDES permit; however, industrial, municipal, and other facilities must obtain permits if their discharges go directly into surface waters. In most cases, the NPDES permit program is administered by authorized states. Since its introduction, the NPDES permit program is responsible for significant improvements to our Nation's water quality.

The NPDES storm water program called for implementation in two phases; Phase I addressed the most significant sources of pollution in storm water runoff. Phase II addresses other sources to protect water quality. Construction sites that disturb one acre or more of land are required to have coverage under the NPDES general permit for storm water discharges from construction site activities.

The United States Environmental Protection Agency has set forth guidelines for municipalities in the NPDES Phase II Storm Water Rule that outlines best management practices (BMPs) for limiting pollutants in storm water drainage systems. Drainage inlet protection devices help to satisfy the following NPDES Phase II control measures: 1) Construction site storm water runoff control; 2) Post-construction storm water management in new development and redevelopment; and 3) Pollution prevention and good housekeeping for municipal operations.

Inlet protection devices have been developed to address the concerns of construction site storm water runoff. Previous inlet protectors may be composed of injection molded plastic housings with a fixed size and shape and particular dimensions. However, fixed dimension plastic inlet protection devices are expensive to tool and can be overly complex to install and maintain.

Other types of inlet protection devices, such as the Illinois Department of Transportation (IDOT) approved Inlet Filter, are comprised of welded steel angles and channels designed to fit specific drainage structures with fixed dimensions. The steel frames also support a sediment bag which filters the storm water. Various geotextile sediment bag materials, oil absorbent pouches, and other filtration devices can be utilized with the IDOT Inlet Filter. The sediment bag hangs below grade catching storm water runoff and debris as it is washed into the drainage structure.

There are hundreds of different sized curb and catch basin inlets in use throughout the world. There are two primary shapes for curb and catch basin inlets: rectangular and circular. Fixed dimension inlet filters are manufactured to fit one specific size of inlet basin. Furthermore, the fabrication of the welded steel frames is tedious and labor intensive resulting in higher cost levels of finished goods, long lead times, and elevated prices. Contractors typically order and stock fixed dimension size inlet filters relating to specific drainage make and model numbers. Contractors that come into contact with a large number of different types of inlet castings may need to stock a large inventory of inlet filters of varying shapes and dimensions. Additionally, pre-existing roadwork may contain inlets of unknown origin and nonstandard dimensions.

Still other types of inlet protection devices are comprised of geotextile fabric sediment bags that are attached to an existing inlet. For example, these sediment bags may be suspended from straps or chains, which are wrapped around or attached to an inlet grate. Some sediment bags have slots adapted to contain pieces of re-bar used to hold down sides of the sediment bag on the outside of the inlet grates, above grade. Other types of sediment bag inlet protection devices require that the inlet grate be inserted into a geotextile envelope preventing sediment from entering at the surface. These "fabric-only" style sediment bag inlet protectors are more difficult to install and maintain than inlet protectors utilizing a "drop-in" rigid frame supporting a sediment bag.

Figure 1:
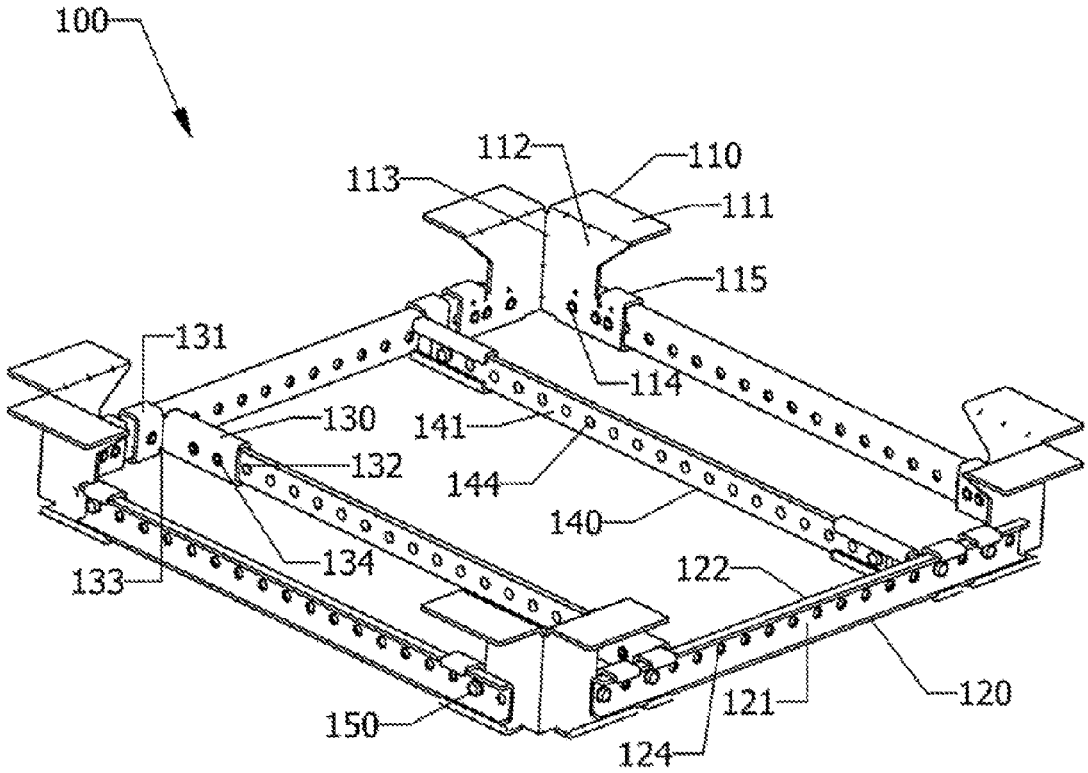
FIG. 1 illustrates a rectangular configurable inlet filter framing system according to an embodiment of the invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE INVENTION

One embodiment of the invention provides for a configurable inlet filter protection device. The configurable inlet filter protection device is comprised of rigid frame rail components with configurable and adjustable dimensions. The frame rail components may be assembled to have the dimension required to fit any inlet opening. Two specific examples provide for frame rail components assembled to have dimensions of 14" length and 10" width and dimensions of 24" length and 12" width. However, the embodiments of the invention are not limited to those specific dimensions. Rather, embodiments of the invention provide for inlet filter framing systems capable of fitting any and all inlet sizes. The configurable dimensions of the frame rail components allow for the inlet filter protection device to fit the wide array of drainage structures in use throughout the world. In one example embodiment, the frame rail components may be comprised of 11 gauge stamped steel components. The configurable frame rail components form a frame to support a sediment bag used to capture pollutants and/or sediment. The inlet filter protection device may be placed within the dimensions of the inlet and may also contact the inlet or drainage structure for support. More specifically, one example embodiment of the invention is designed to drop in the casting opening and hang suspended from the load bearing lips of the casting beneath the drainage gate. The structure of at least one embodiment of the invention provides an inherent overflow gap vertically spaced below the drainage grate and the top of the sediment bag.

Certain embodiments of the invention may be placed in a typical cast inlet, or any other drainage structure. For example, inlet filter devices may be placed into a plastic or concrete storm drainage structure. In some instances, the inlet filter devices are placed in metal, plastic, or concrete storm drainage structures 20-28 inches in diameter. Another example embodiment may be placed right on the concrete lid of a catch basin, which is typically 24 inches in diameter or a 24-48 inch square opening. In a preferred embodiment of the invention, the dimensions of the inlet filter framing device may be adjusted by a user at the location of the inlet. For example, if the inlet filter device as assembled is larger than an inlet, a user may configure the framing device to accommodate the smaller inlet. In another example, a user may remove an inlet filter framing device, adjust the framing device to increase its dimensions, and fit the inlet filter framing device in a larger inlet.

Additionally, other example embodiments of the invention are configured to drop in rectangular and circular inlet shapes with frame rail dimensions slightly smaller than the clear drainage opening. In some example embodiments of the invention, the frame rails can be adjusted to just less than the clear drainage opening of an inlet casting or any other type of drainage structure. Typically, the frame rails are dimensioned such that there is range of 0.1" to 1.1" clearance around the perimeter of the frame structure. A preferred embodiment of the invention provides for 0.5" of clearance. Other embodiments of the invention provide a funnel flange to collect any runoff falling through the clearance gap and funnel it back through the sediment bag. Embodiments of the invention may be referred to as The FLeXstorm™ Inlet Filter System.

FIG. 1 illustrates a rectangular configurable, i.e. adjustable, inlet filter framing system 100 according to an embodiment of the invention. The rectangular configurable inlet filter framing system 100 includes corner bracket 110, frame rail channels 120, lifting brackets 130, lifting rails 140, and bolts 150.

The corner bracket 110 may be comprised of one or more rigid materials, such as steel. The corner bracket 110 includes hangers 111, hanger support structure 112, corner angle 113, holes 114, and frame rail channel contacts 115. In a preferred embodiment, a corner bracket 110 comprises a hanger support structure 112 comprising two planar steel surfaces adjoined transversely at angle 113. Additionally, the hanger support structure 112 is adjoined transversely to at least one hanger 111. In a preferred embodiment, the hangers 111 are planar pieces of steel. Hangers 111 contact the edges of an inlet to support the weight of the rectangular configurable inlet filter framing system 100. The hangers 111 are designed to contact the perimeter of an inlet and allow the configurable rectangular inlet filter framing system 100 to rest primarily below grade in order to filter liquids and solids entering a drainage system.

Further, hanger support structure 112 includes a plurality of holes 114 and a plurality of frame rail contacts 115. The holes 114 are located transversely through the planar surfaces of hanger support structure 112. In a preferred embodiment, the holes 114 located through corner bracket 110 have the same orientation as the holes 124 in frame rail 120. The frame rail contact 115 is a rigid structure in contact with hanger support structure 112 and is adapted to receive a frame rail channel 120. Additionally, a frame rail contact 115 may allow for a frame rail 120 to be moved in one dimension while limiting movement in two other transverse dimensions. The frame rail contact 115 may comprise a steel channel adapted to receive a smaller steel channel. Alternate embodiments of corner bracket 110 may include only one hanger 111. Additionally, the angle 113 is not required to be 90 degrees.

The frame rail channel 120 includes a first planar surface 121, second planar surface 122, and holes 124. In a preferred embodiment, the frame rail channel 120 is comprised of steel channel. The first planar surface 121 is adjoined transversely to two planar surfaces 122. The holes 124 are located transversely through first planar surface 121.

The lifting bracket 130 includes a frame rail contact 131, a lifting rail contact 132, an angle 133, and holes 134. The frame rail contact 131 and lifting rail contact 132 are rigid structures adjoined transversely and adapted to receive a frame rail 120 and a lifting rail 140 respectively. Additionally, frame rail contact 131 may allow for a frame rail 120 to be moved in one dimension while limiting movement in two other transverse dimensions. Likewise, lifting rail contact 132 may allow for a lifting rail 140 to be moved in one dimension while limiting movement in two other transverse dimensions. The frame rail contact 131 and lifting rail contact 132 may comprise steel channel adapted to receive a smaller steel channel or bar. In a preferred embodiment, a lifting rail bracket 130 may comprise a single piece of steel channel formed at approximately a 90 degree angle. The lifting bracket 130 includes holes 134 located transversely through frame rail contact 131 and the lifting rail contact 132. In a preferred embodiment, the holes 134 located through frame rail contact 131 have the same orientation as the holes 124 in frame rail 120. Likewise, the holes 134 located through lifting rail contact 132 have the same orientation as the holes 144 through lifting rail 140.

The lifting rail 140 includes a first planar surface 141 and holes 144. The lifting rail is preferably a rigid structure capable of being secured to one or more lifting brackets 130. The lifting rail 140 may be a steel channel or flat piece of steel bar. The holes 144 are transversely located through the first planar surface 141.

The bolts 150 may be bolts, bolted joints, screws, screw joints, pin joints, rivets, or any other rigid fastener capable of attaching two surfaces together.

The corner brackets 110, frame rail channels 120, lifting brackets 130, lifting rails 140, and bolts 150 are connected to form the rectangular configurable inlet filter framing system 100. Specifically, four corner brackets 110 are oriented to form the four corners of a rectangle. Four frame rail channels 120 are oriented to form the four sides of a rectangle. In certain embodiments, the four corner brackets 110 and four frame rail channels 120 form a square. Two lifting brackets 130 are oriented in contact with a first frame rail 120. Two more lifting brackets 130 are oriented in contact with a second frame rail 120 which is parallel to first frame rail 120. Two lifting rails 140 are oriented to contact the two lifting brackets in contact with the first frame rail channel 120 with the two lifting brackets in contact with the second frame rail channel 120.

Bolts 150 secure the components of the rectangular configurable inlet filter framing system 100. More specifically, at least one bolt 150 connects each frame rail 120 to a corner bracket 110. Additionally, at least one bolt 150 connects each lifting rail 140 to a lifting bracket 130. In a preferred embodiment, the corner brackets 110 include a plurality of extruded holes 114 and are spaced ½" apart. The preferred embodiment also includes frame rails 120 which are steel channel lengths with through holes 124 spaced 1" apart. The preferred embodiment also includes bolts 150 which are ¼-20 thread forming fasteners, eliminating the need for washers and nuts on the ¼-20 bolts. The bolts 150 are threaded through the extruded holes 114 and 124 to secure the corner brackets 110 to the frame rails 120. Likewise, the lifting brackets 130 include a plurality of extruded holes 134. The extruded holes 134 are spaced ½" apart. The lifting rails 140 are steel channel lengths with through holes 144 spaced 1" apart. Bolts 150 are threaded through the extruded holes 134 and 144 to secure the lifting brackets 130 to the lifting rails 140. In alternative embodiments of the invention, holes 114 or 124 may be any opening in the surface of the corner bracket 110 or the frame rail 120. For example, the holes 114 or 124 may actually be a slot, through which a pin or bolt may placed into and/or through. The pin or bolt may be secured with a clip or nut to secure it into position.

In a preferred embodiment of the invention, the components of the rectangular configurable inlet filter framing system 100 provide for a system capable of forming to the dimensions of a wide variety of rectangular inlet shapes. For example, the spacing of the holes 114 in the corner brackets 110 and the spacing of the holes 124 in the frame rails 120 allow for the corner brackets 110 and the frame rails 120 to be secured by bolts 150 in a variety of configurations. The frame rails 120 may be 20" long steel channels while the corner brackets 110 may have sides capable of receiving 3" frame rails 120. As described above, the extruded holes 134 in the preferred embodiment are spaced ½" apart and the through holes 144 spaced 1" apart. This allows for inlet filter framing system 100 width and length adjustments in ½" increments and up to 5" per side using only ¼-20 thread forming fasteners 150. Additionally, the frame rails 120 and lifting rails 140 may be any length of steel channel or bar. If an inlet filter framing system 100 needs to be adjusted by more than 5" inches in a dimension to fit a different inlet basin, frame rails 120 of a different length may be substituted. Likewise, different length lifting rails 140 may also be substituted. A preferred embodiment of the invention allows for a user to adjust the inlet filter framing system to fit a variety of inlet structures. For example, if an inlet filter framing system need to be enlarged to properly fit an inlet, the bolts securing the frame rails to the corner brackets may be adjusted to increase the dimensions of the inlet filter framing system.

The lifting rails 140 provide for a point to secure a lifting tool capable of lifting the configurable rectangular inlet filter framing system 100 in and out of an inlet basin. The configurable rectangular inlet filter framing system 100 may be assembled by bolting the interchangeable components together and placing the system 100 into an inlet. The system 100 may be configured, i.e. adjusted, to fit a different sized inlet by moving the bolt 150 to a different hole in the corner bracket 110 and/or the frame rail 120. Alternatively, different sized frame rails 120 may be substituted into the system 100. Other alternative embodiments of the invention provide for lifting brackets 130 and lifting rails 140 to connect perpendicular frame rails 120.

Alternate embodiments of the configurable, adjustable rectangular inlet filter framing system 100 include corner brackets 110 adapted to fit a variety of inlet configurations and drainage structures. For example, the corner bracket 110 may only include one hanger 111. Alternatively different corner brackets 110 may have hangers 111 of differing heights. The hanger 111 is designed to contact the perimeter of an inlet and allow the configurable rectangular inlet filter framing system 100 to rest primarily below grade in order to filter liquids and solids entering a drainage system. Certain rectangular inlets have a perimeter substantially at the same grade as a road. However, other rectangular inlet basins have a perimeter at the same grade as a road and also a rear portion along a curb. In one alternative embodiment, the system 100 will include a first two corner brackets 110 with hangers 111 and a second two corner brackets 110 with hangers 111 located 6" higher than the hangers 111 on the first two corner brackets. Thus, two sets of hangers 111 may rest on the road portion of an inlet while two other sets of hangers 111 may rest on the curb portion of an inlet.

Figure 2:
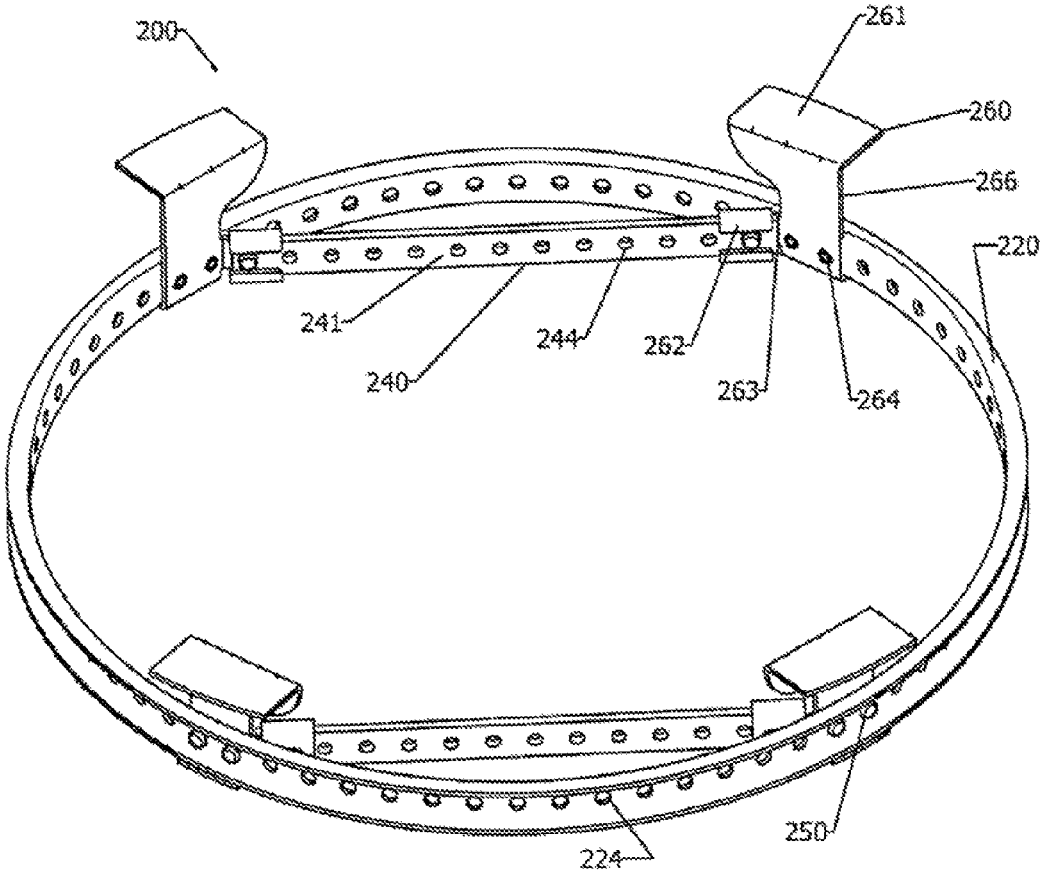
FIG. 2 illustrates a circular configurable inlet filter framing system according to an embodiment of the invention.

FIG. 2 illustrates a circular configurable inlet filter framing system 200 according to an embodiment of the invention. The circular configurable, i.e. adjustable, inlet filter framing system 200 includes circular brackets 260, circular channel 220, lifting rails 240, and bolts 250.

The circular bracket 260 may be comprised of one or more rigid materials, for example steel. The circular bracket 260 includes hangers 261, lifting rail contacts 262, holes 264, and circular channel contact 266. In a preferred embodiment, a circular bracket 260 comprises a circular channel contact 266 and a lifting rail contact 262 adjoined at angle 263 and adapted to receive a circular channel 220 and a lifting rail 240 respectively. Additionally, the circular bracket 260 is adjoined transversely to at least one hanger 261. In a preferred embodiment, the hangers 261 are planar pieces of steel. Hangers 261 contact the edges of a circular inlet or concrete drainage structure to support the weight of the circular configurable inlet filter protection system 200. The hangers 261 are designed to contact the perimeter of an inlet and allow the configurable circular inlet filter framing system 200 to rest primarily below grade in order to filter liquids and solids entering a drainage system.

Further, circular rail contact 266 includes a plurality of holes 264. In a preferred embodiment, the holes 264 located through circular rail contact 266 have the same orientation as the holes 224 in circular channel 220. The lifting rail contact 262 is a rigid structure in contact with circular channel contact 266 and adapted to receive a lifting rail 240. In a preferred embodiment, the lifting rail contact 262 includes holes 264 with the same orientation as the holes 244 in lifting rail 240. Additionally, a lifting rail contact 262 may allow for a lifting rail 240 to be moved in one dimension while limiting movement in two other transverse dimensions. The lifting rail contact 262 may comprise a steel channel adapted to receive a smaller steel channel or bar.

The circular channel 220 includes holes 224. In a preferred embodiment, the circular channel 220 is comprised of steel channel rolled into circles of standard inlet opening diameters. The holes 264 are located diametrically through the circumference of circular channel 220. The channel ends are connected at one of four circular brackets 260, each of which contains two fasteners.

The lifting rail 240 includes a first planar surface 241 and holes 244. The lifting rail 240 is preferably a rigid structure capable of being secured to one or more circular brackets 260. The lifting rail 240 may be a steel channel or flat piece of steel. The holes 244 are transversely located through the first planar surface 241.

The bolts 250 may be bolts, bolted joints, screws, screw joints, pin joints, rivets, or any other rigid fastener capable of attaching two surfaces together. Bolts 250 secure the components of the circular configurable, adjustable inlet filter framing system 200. More specifically, four circular brackets 260 are bolted to circular channel 220. The bolts pass through holes 264 of each circular channel contact 266. Additionally, two lifting rails 240 are each bolted to two of the 4 circular brackets 260.

In a preferred embodiment, the circular brackets 260 include a plurality of extruded holes 264 and are spaced 1" apart. The circular channel 220 in a preferred embodiment is a rolled steel channel length with through holes 224 spaced 1" apart. The bolts 250 are ¼-20 thread forming fasteners. The bolts 250 are threaded through the extruded holes 264 and 224 to secure the circular channel contact 266 to the circular channel 220. Likewise, the lifting rail contacts 262 include extruded holes 264. The lifting rails 240 are flat steel bar lengths with through holes 244 spaced 1" apart. Bolts 250 are threaded through the extruded holes 264 and 244 to secure the lifting rail contacts 262 to the lifting rails 240. Alternative embodiments provide for holes 224 and holes 244 with spacing other than 1" apart.

In a preferred embodiment of the invention, the components of the circular configurable inlet filter framing system 200 provide for a system capable of forming or adjusting to the dimensions of a wide variety of circular inlet shapes. For example, the circular channel 220 may be formed to any diameter. Likewise, the lifting rails 240 may be formed in any length. In one example, circular configurable inlet filter framing system 200 is configured for a 20" diameter inlet. The system 200 includes a 20" diameter circular channel 220. In order to accommodate a 24" diameter inlet, the 20" diameter circular channel 220 can be replaced by a 24" diameter circular channel 220. All other components of the system 200 may remain unchanged. Alternatively, the frame rails 240 may be replaced with longer frame rails 240. In another alternative embodiment, the circular channel 220 may be adjustable or configurable. For example, the circular channel 220 may be segmented into 2 or more rolled lengths of a nominal radius. The segments may be connected and adjusted at each circular bracket 260 using a plurality of extruded holes 264 and bolts 250. Furthermore, the circular channel and/or channel segments may be rolled such that portions of the circular channel 220 overlap. The circular configurable inlet filter framing system 200 may be adjusted to fit a larger diameter circular inlet by adjusting circular channel 220 such that amount of overlapping channel is decreased and/or effectively increasing the diameter of the circle formed by the circular channel 220. Similarly, to accommodate a smaller diameter circular inlet, the reverse operation could be performed. These adjustments and configurations may be performed at the location of an inlet, even after a circular inlet framing system has already been assembled. Certain embodiments of the invention provide for adjusting the configuration of a circular inlet frame through the use of bolts, screws, pins, or rivets, etc. that pass through holes, slots, openings, etc of the inlet frame and/or bracket. These adjustments may be performed by an unskilled laborer and without welding, thereby decreasing costs and increasing efficiency.

Figure 3:
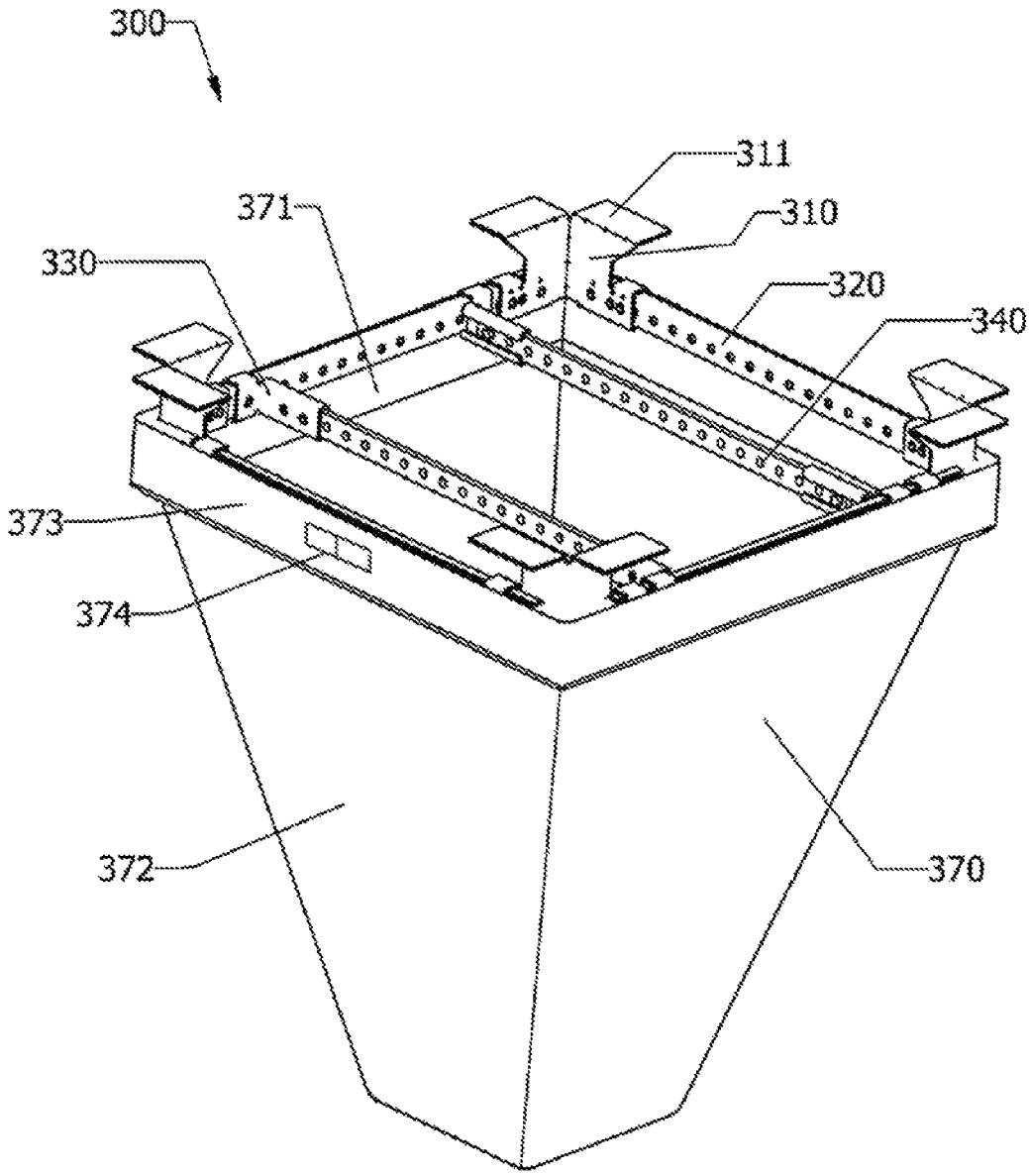
FIG. 3 illustrates a rectangular configurable inlet filter protection system with according to an embodiment of the invention.

FIG. 3 illustrates a rectangular configurable inlet filter protection system 300 with according to an embodiment of the invention. The rectangular configurable, adjustable inlet filter protection system 300 is similar to the system illustrated in FIG. 1. The rectangular configurable inlet filter protection system 300 includes corner brackets 310, frame rail channels 320, lifting brackets 330, lifting rail channels 340, and sediment bag 370.

The corner bracket 310, frame rail channels 320, lifting brackets 330, and lifting rails 340 are similar to corner brackets, frame rail channels, lifting brackets, and lifting rails described elsewhere in this application.

The sediment bag 370 is comprised of inner layer 371, outer layer 372, compartment 373, and opening 374. The sediment bag is 370 is provided to limit and/or prevent pollution from entering a drainage inlet. The sediment bag 370 is comprised of an inner layer 371 and outer layer 372. In a preferred embodiment, the inner layer 371 is a geotextile fabric filter with a typical flow rate between 140 and 200 gpm/sq yd. The inner layer 371 filter may be either woven or non-woven. The outer layer 372 is preferably a flexible polyester mesh weighing at least 4 oz/sq yd. The outer layer 372 may reinforce the inner layer 371. Additionally the outer layer 372 may include bright colors, such as orange, to signal the presence of an inlet protection device.

The sediment bag 370 is attached to the frame of the rectangular configurable inlet filter protection system 300 with a stainless steel quick release style locking hose clamp. The hose clamp is threaded through compartment 373 and tightened. The tightened hose clamp and compartment 373 are supported by the channels of frame rail channels 320. The stainless steel hose clamp is inserted into compartment 373 through opening 374. The cone shaped sediment bag 370 is designed so as not to expand beyond the frame's perimeter, which is slightly smaller than the clear opening of the casting.

In operation, the rectangular configurable inlet filter protection system is assembled as described elsewhere in this application. Additionally, the stainless steel hose clamp is threaded through compartment 373 and tightened to press sediment bag 370 against frame rails 320. The rectangular configurable inlet filter protection system 300 is lowered into an inlet with corner brackets 310 supporting the weight of the system 300 on a load bearing surface. When water enters the inlet and falls below grade, the water contacts the inner layer 371 of sediment bag 370. The inner layer 371 filters out sediment and foreign objects while letting the runoff water pass through. As sediment is collected in the sediment bag 370 through the filtering process, the sediment fills up the sediment bag 370. The outer layer 372 supports the weight of the sediment collected in the sediment bag. When a sediment bag 370 is full, the sediment bag may have a reduced or eliminated ability to allow water flow. The diminished water flow rate may lead to localized flooding. One of the benefits of the invention is to reduce the possibility of such flooding.

In a preferred embodiment of the invention, the inlet filter protection system provides for an overflow bypass. For example, the hanger brackets 310 include hanger hooks 311 which support the weight of the inlet filter protection by contacting the perimeter of the inlet. The rest of the of inlet filter protection system hangs below grade. The height of the corner brackets 310 may be configurable or adjustable. For example, the corner bracket 310 could be configured so that the frame rails 320 and sediment bag 370 hang either at grade or immediately below grade. In this scenario, a full sediment bag 370 could lead to overflow flooding. Alternatively, the height of the corner brackets 310 could be configured so that the frame rails 320 and sediment bag 370 hang several inches below grade. In this scenario, when the sediment bag 370 is full, runoff water may spill over the frame rails to enter the inlet. Although this may result in reduced filtering, the overflow bypass will eliminate or greatly reduce the possibility of flooding the areas surrounding drainage structure. This will allow roads and jobsites to completely drain, thus eliminating the hazards of standing water, icing, and/or jobsite erosion.

Additionally, the sediment bag 370 is designed to be reused and/or easily replaceable. The hose clamp may be loosened with a single bolt or screw, allowing for the sediment bag to be detached from the inlet filter frame. The sediment bag 370 may either be cleaned and reattached, or replaced with another sediment bag 370.

Some inlet castings have open curb backs allowing water to bypass the main drainage grate and filter system. Certain embodiments of the invention include a sediment bag 370 with a curb guard flap. The curb guard flap is typically sewn to the sediment bag 370 and may be pulled up over the front of the curb box opening. Alternative embodiments of the curb guard flap are a stand alone assembly. The separate, stand alone curb guard flap may be partially secured under the casting grate. Other stand alone curb guard flaps may attach to the rest of the assembly with hook and loop, snaps, or other reusable fasteners. Alternatively, a stand alone curb guard flap may use magnets to secure the stand alone curb guard flap to the inlet casting. For example, two magnets sewn into corner pockets may secure the lower portion of a stand alone curb guard flap to the grade level surface on an inlet casting, while two additional corner magnets may secure the upper portion of a stand alone curb guard flap to the curb level surface of an inlet casting. Alternative embodiments may also use different numbers and locations of magnets and/or fasteners.

In a preferred embodiment of the invention, the curb guard flap utilizes magnets located within the corners of the curb guard flap to secure the curb guard flap to the inlet casting. This embodiment improves curb guard flap designs which require a large surface area to stake down or hold the curb guard flap in position to effectively cover the curb opening. In this preferred embodiment, the curb guard flap includes pockets sewn within the curb guard flap capable of storing magnets. The pocket openings may be secured, for example, by Velcro. In one example embodiment, the magnet pockets located at the corners of the curb guard flap hold 1"×1"×0.25" corrosion resistant neodymium magnets. In other embodiments, magnets of different sizes and materials may be used. Additionally, the magnet pockets may be located elsewhere in the curb guard flap. Typically 1 magnet with approx 30 lbs holding force at each corner is required, however additional magnets may be inserted for especially long curb openings requiring additional holding force.

The curb guard flaps are constructed of 2-ply material, like the sediment bag 370. The inner layer of the curb guard flap may be similar to the inner layer 371 of the sediment bag 370. Likewise, the outer layer of the guard flap may be similar to the outer layer 371 of the sediment bag 370. Additionally, the outer layer of the curb guard flap may be a bright orange polyester mesh, which reinforces the curb guard flap while providing notice of the inlet protection device covering the curb box opening. The brightly colored material may alert street sweepers to the presence of the curb guard flap material in order to prevent the street sweepers from contacting the curb guard flap and tearing portions away. If a street sweeper does catch the flap, the magnets will give way as a fail safe and the fabric will not be torn apart. Furthermore, the highly visible curb guard flaps may also incorporate company logos or other warnings such as "Dump No Waste—Drains to Lake."

The sediment bag 370 is also designed to be used with circular inlet protection devices, such as the device shown in FIG. 2. In circular embodiments, the sediment bag 370 is attached to the frame of the circular configurable inlet filter framing system 200 with a stainless steel quick release style locking hose clamp. The hose clamp is threaded through a compartment in the sediment bag 370 and tightened. The tightened hose clamp and compartment 373 are supported by the channels of circular channels 220. The sediment bag 370 is designed so as not to expand beyond the frame's perimeter, which is slightly smaller than the clear opening of the casting.

Figure 4:
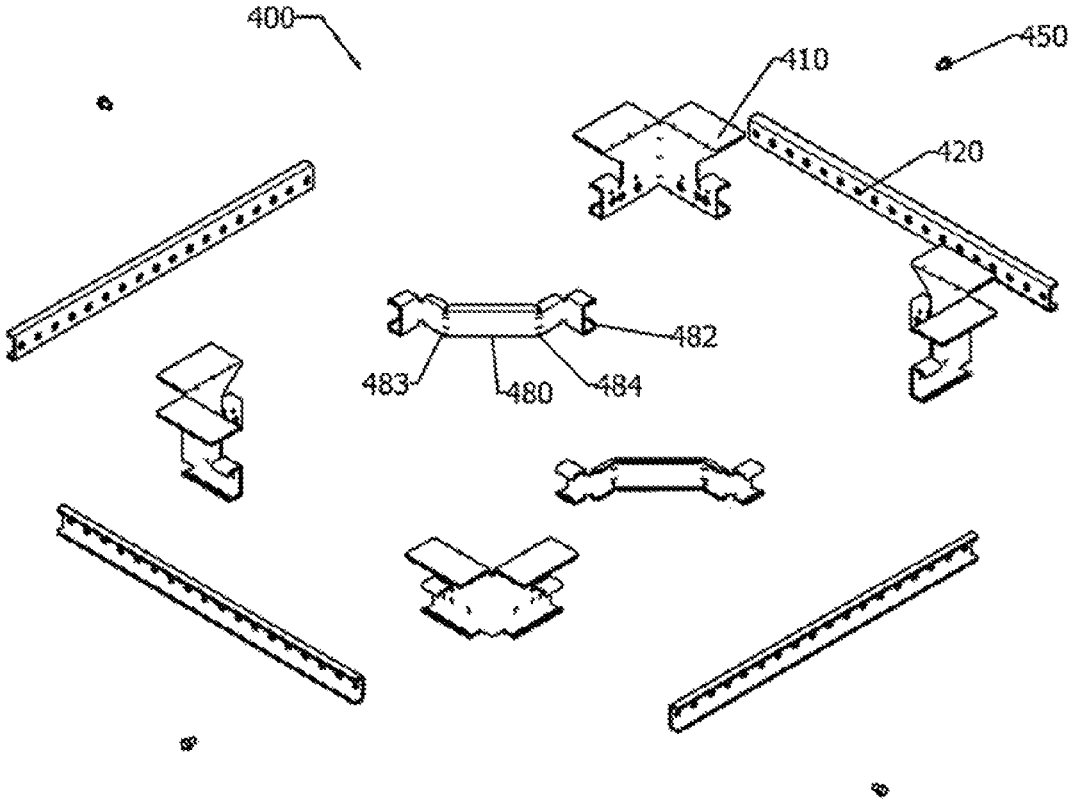
FIG. 4 illustrates an exploded view of a modified rectangular configurable inlet filter framing system according to an embodiment of the invention.

FIG. 4 illustrates an exploded view of a modified rectangular configurable inlet filter framing system 400 according to an embodiment of the invention. The modified rectangular configurable inlet filter framing system 400 is similar to the system illustrated in FIG. 1. The rectangular configurable, adjustable inlet filter framing system 400 includes corner brackets 410, frame rail channels 420, and lifting brackets 480. The corner bracket 410 and frame rail channels 420 are similar to corner brackets and frame rail channels described elsewhere in this application. Like other lifting brackets, the lifting brackets 480 are a rigid material secured to the frame of the inlet protection device. In a preferred embodiment, the lifting bracket 480 may be a formed steel channel. The lifting brackets 480 are used to lift an inlet protection device out of an inlet casting. The lifting brackets 480 are oriented in such a manner to make it easier and more efficient to remove an inlet framing device in order to empty a sediment bag. Additionally, orienting the lifting brackets 480 at the corners of the inlet framing device requires less material than lifting brackets spanning parallel sides of an inlet frame, thus reducing cost and weight. A lifting tool may be hooked underneath the lifting brackets 480 and used to remove the inlet protection device.

However, the lifting brackets 480 provide some differences from the lifting brackets illustrated in other figures. Unlike other lifting brackets which attach a lifting rail to two parallel frame rail channels, the lifting brackets 480 operate as a lifting rail while contacting two perpendicular frame rail channels 420. As shown in FIG. 4, the lifting brackets 480 are located at two of the corners of modified rectangular configurable inlet filter framing system 400. In certain embodiments, the lifting brackets 480 are a fixed length piece of formed steel channel. The lifting brackets may be used with varying lengths of frame rail channels 420 providing for configurable dimension inlet protection devices.

The lifting bracket 480 includes frame rail contacts 482, first angle 483, and second angle 484. The frame rail contacts 482 are rigid structures at each end of the lifting bracket 480 and adapted to receive a frame rail 420. Additionally, frame rail contact 482 may allow for a frame rail 420 to be moved in one dimension while limiting movement in two other transverse dimensions. The frame rail contact 482 may comprise a steel channel adapted to receive a smaller steel channel. The lifting bracket 480 may be formed with first angle 483 and second angle 484. In a preferred embodiment first angle 483 and second angle 484 are equal. In alternative embodiments, first angle 483 and second angle 484 are unequal.

In a preferred embodiment, the lifting bracket 480 is secured to a frame rail channel 420 by coupling the steel channel of a frame rail channel 420 to the larger steel channel of a lifting bracket 480. This may be achieved by sliding a frame rail channel 420 through a frame rail contact 482. In some embodiments, the frame rail contact 482 may also include an extruded hole or other opening such as a slot, to allow a bolt so secure the frame rail contact 482 to the frame rail channel 420. As in other configurable systems, the frame rail channels 420 and corner brackets may be interchanged, providing for a configurable rectangular inlet protection system.

Figure 5A:
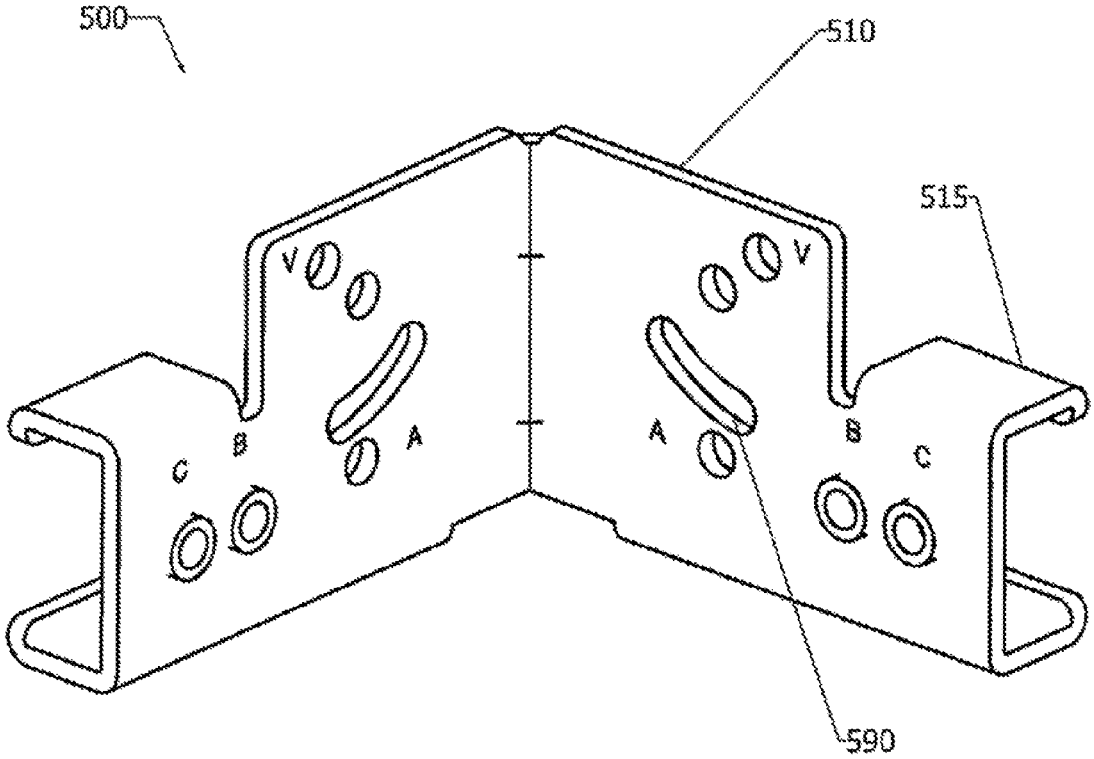
FIGS. 5A, 5B, and 5C illustrate an improved configurable universal bracket and a configurable hanger hook according to an embodiment of the invention.
Figure 5B:
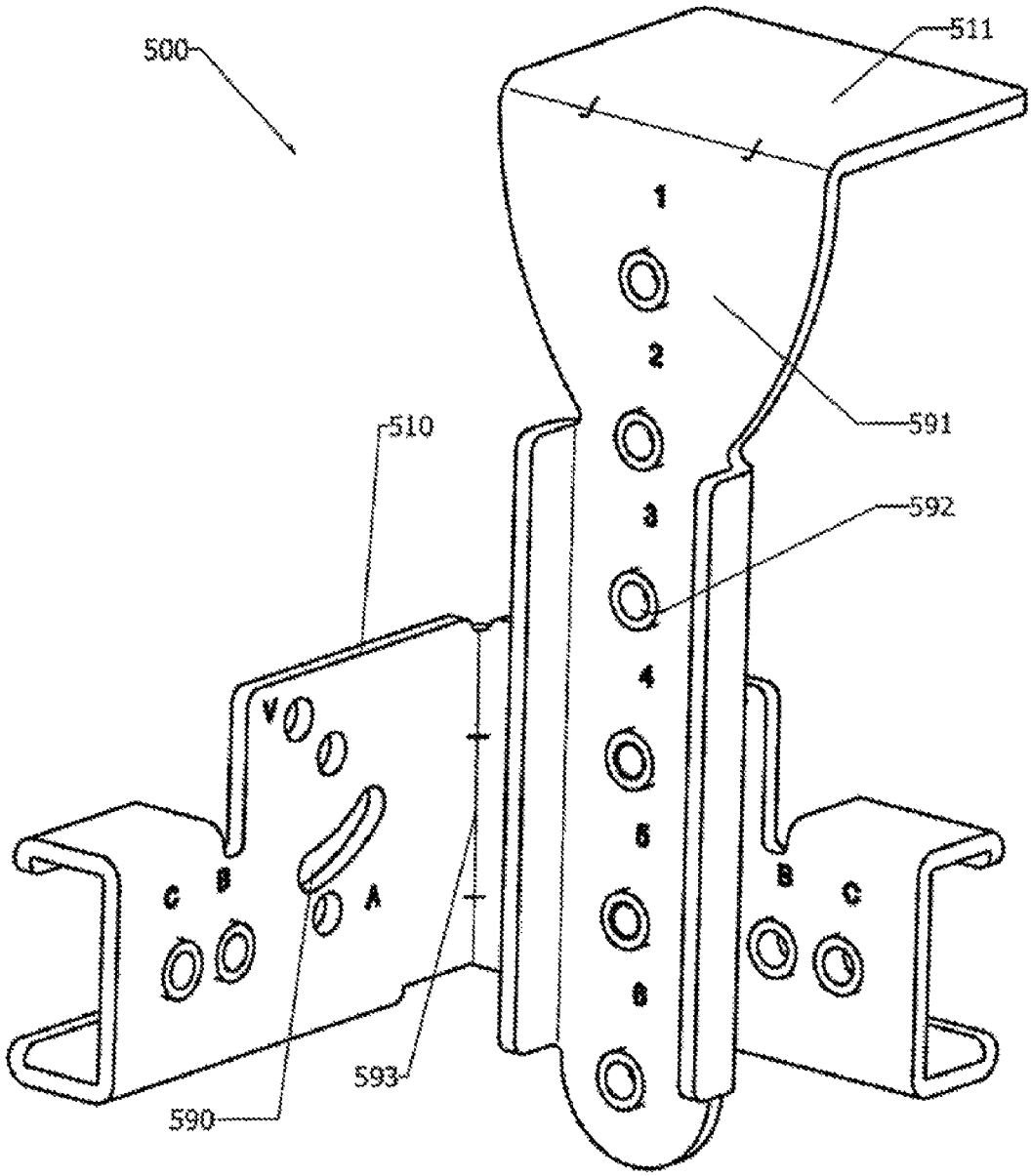
Figure 5C:
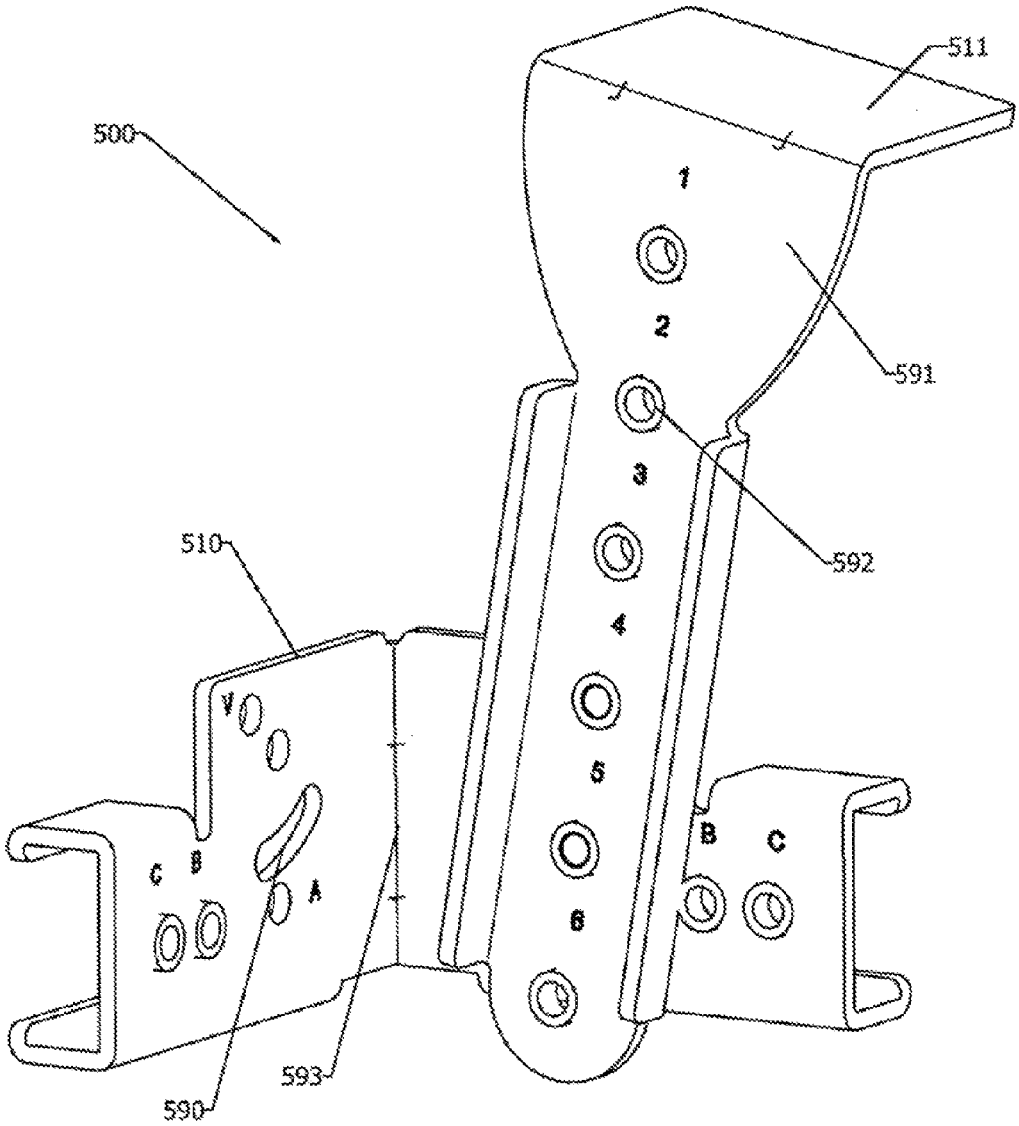

FIGS. 5A, 5B, and 5C illustrate an improved configurable universal bracket and a configurable hanger hook 500 according to an embodiment of the invention. The configurable universal bracket and configurable hanger hook 500 may be a part of a rectangular configurable inlet filter protection system as described elsewhere in this application. The configurable universal bracket and configurable hanger hook 500 may adjusted by a user before or after being assembled as part of an inlet filter framing device. Additionally, the configurable hanger hook is capable of adapting to a rolled curb.

The configurable universal bracket and configurable hanger hook 500 as shown in FIG. 5A includes universal corner bracket 510, frame rail channel contact 515, and hanger hook orientation adjuster 590.

The universal corner bracket 510 may be comprised of one or more rigid materials, for example steel. In a preferred embodiment, the universal corner bracket 510 may be used as a component in a rectangular configurable inlet protection system. As described elsewhere in the application, the corner bracket is connected to a frame rail channel at frame rail contact 515. The universal corner bracket 510 can be used with any length of frame rail channel. Additionally, the universal corner bracket 510 may include a plurality of holes through which a frame rail can be connected to a universal corner bracket 510. Further, the universal corner bracket 510 can be connected to a hanger. The hanger may be similar to other hangers described in this application. The hanger hook orientation adjuster 590 can be used to adjust the orientation of a hanger hook with respect to the universal corner bracket 510. For example, a hanger hook may be transversely connected to a universal corner bracket 510. The hanger hook may be connected to the universal corner bracket 510 by a screw through the hanger hook orientation adjuster 590. A user may adjust the orientation of the hanger hook by adjusting the position of the screw through the hanger hook adjuster orientation 590.

In operation, a configurable hanger hook 591 may be connected to a universal corner bracket 510 as shown in FIG. 5B. Configurable hanger hook 591 further includes hanger 511 and holes 592. Hanger 511 is designed to contact an inlet or curb surface and support the weight of a configurable inlet device. Holes 592 are designed to accept screws, bolts or other fasteners in order to connect configurable hanger hook 592 to universal corner bracket 510. As shown in FIG. 5B, the universal corner bracket 510 forms a right angle 593. The configurable hanger hook 592 is oriented perpendicular to the plane described by right angle 593. In other embodiments, angle 593 may be greater or less than 90 degrees.

FIG. 5C illustrates the configurability and adjustability of configurable universal bracket and configurable hanger hook 500. More specifically, the configurable hanger hook 592 is no longer oriented perpendicular to the plane described the right angle 593. In operation, a user can adjust the angle of the configurable hanger hook 592 with respect to the universal corner bracket 510 by adjusting the connector that connects configurable hanger hook 592 and universal corner bracket 510 through holes 592 and hanger hook orientation adjuster 590. The hanger hook may be rotated between 5 and 45 degrees with respect to the planar grade surface engaging load bearing lips of inlet castings with V-grate or gutter style configurations.

A user may wish to use a configurable inlet filter system in a variety of environments. For example, a configurable inlet filter system may initially be placed in a below grade rectangular inlet. In this scenario, the configurable hanger hooks 592 comprising a rectangular configurable inlet filter system may all be equal lengths and oriented perpendicular to the universal corner brackets 510. A user may replace or adjust components of the configurable inlet filter system to adapt the inlet filter system to another type of inlet. More specifically, the inlet filter system residing entirely below grade may be configured to rest in an inlet on a curb. A user may replace or more configurable hanger hooks 592 comprising the inlet filter system with longer configurable hanger hooks 592. For example, two configurable hanger hooks 592 may be 3 inches long and have hangers 511 resting at grade level. The other two configurable hanger hooks 592 may be 8 inches long and have hangers 511 resting at curb level. As shown in FIG. 5C, the configurable inlet filter system can be further adapted to fit a rolled curb. The orientation of the configurable hanger hooks 592 with respect to the universal corner brackets 510 can be adjusted such that the hangers 511 of the configurable hanger hooks 592 contact the surface of a curb. Embodiments of the configurable hanger hooks 592 are adapted to work with straight, curved, sloped, rolled or any other type of curb orientation.

Figure 6A:
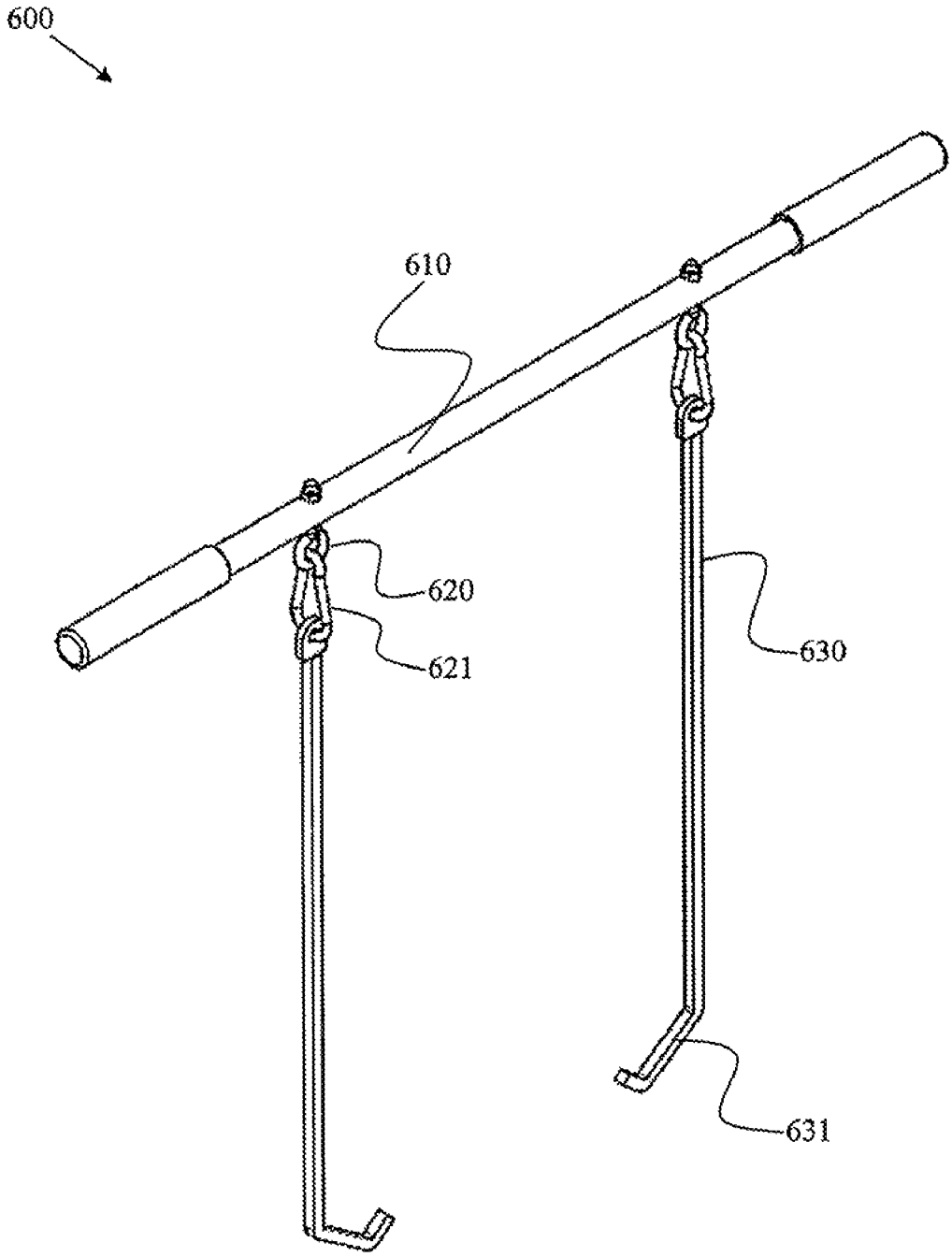
FIGS. 6A, 6B, and 6C illustrate a configurable lifting tool according to an embodiment of the invention.
Figure 6B:
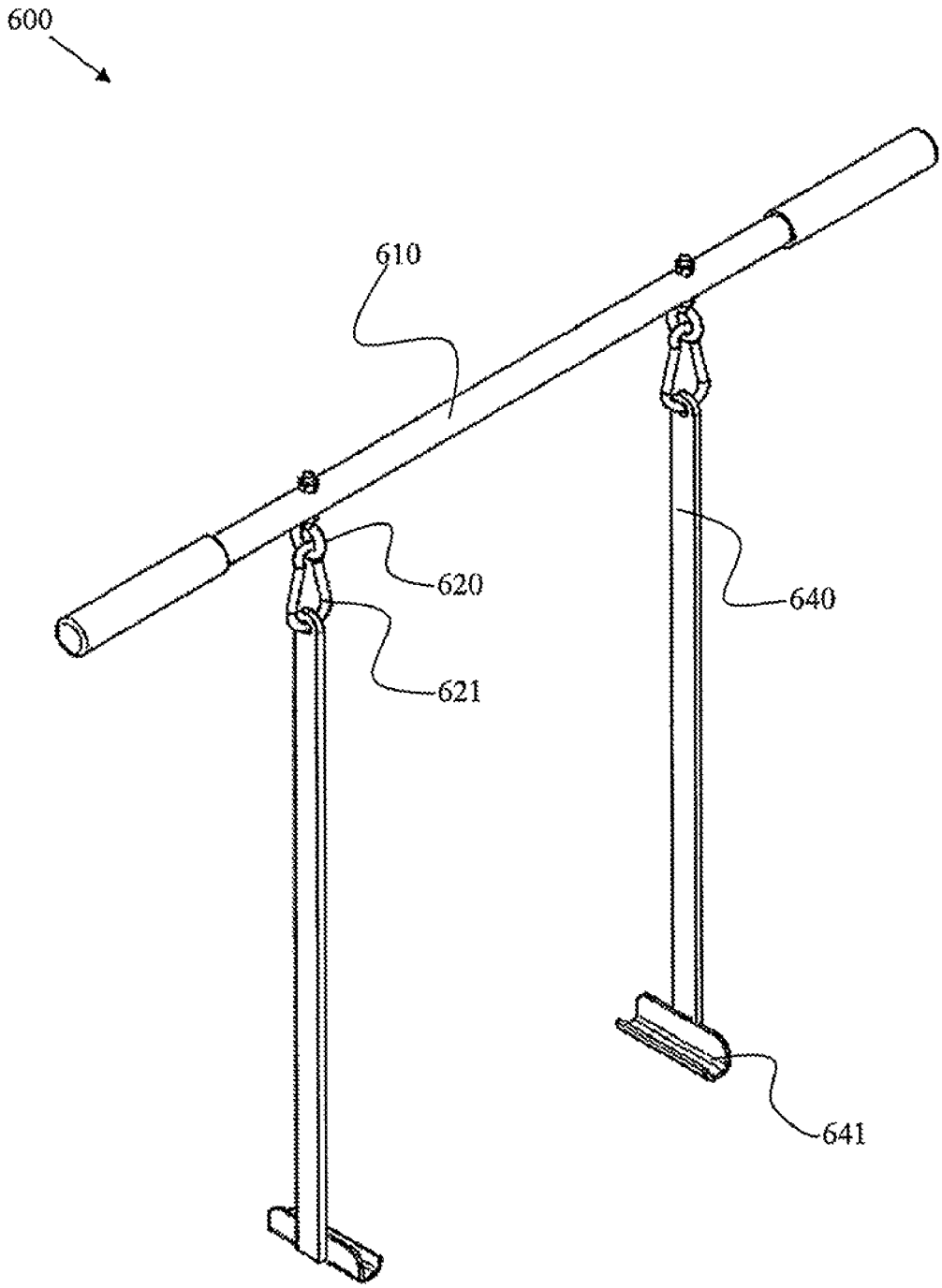
Figure 6C:
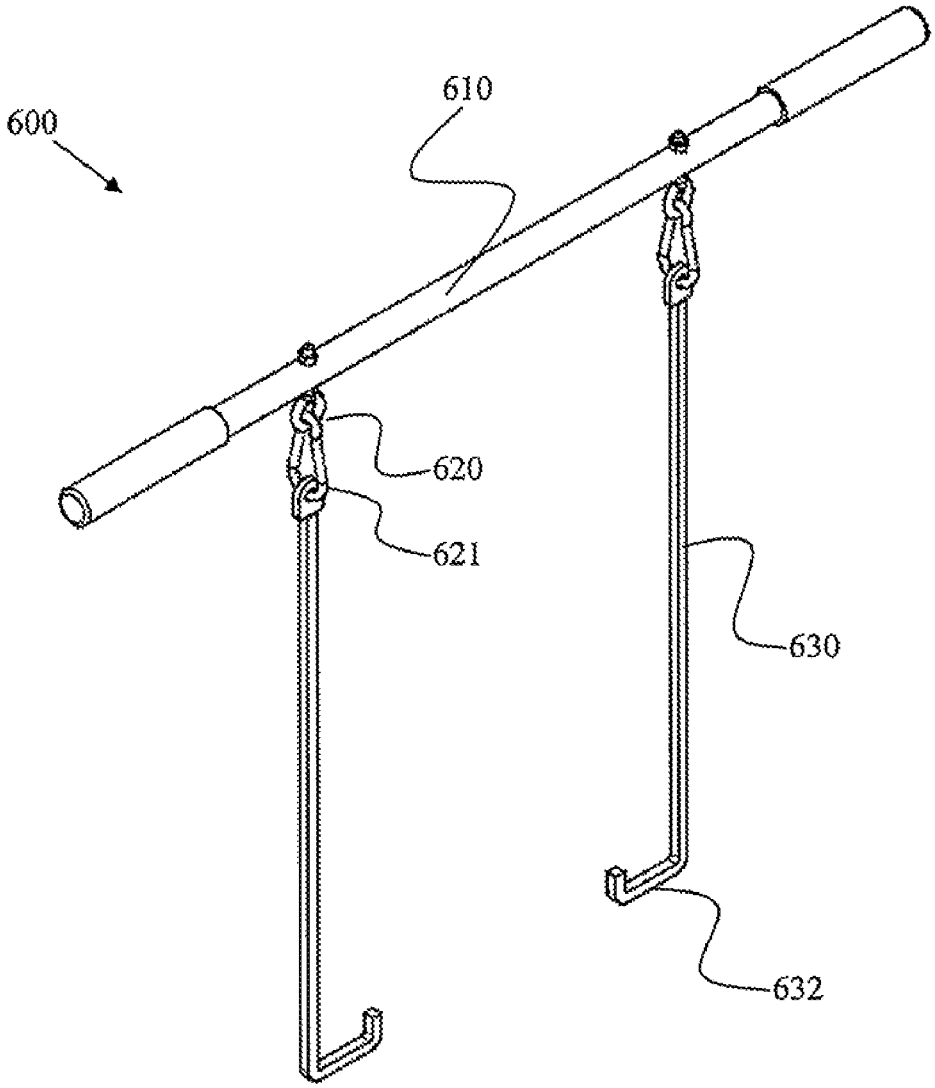

FIGS. 6A, 6B, and 6C illustrate a configurable lifting tool 600 according to an embodiment of the invention. The configurable lifting tool 600 comprises a lifting bar 610, eye bolts 620, connectors 621, and one or more lifting bars. FIG. 6A illustrates a lifting tool 600 with two lifting arms 630. One end of the lifting arm 630 is adapted to receive the connector 621, while the other end of the lifting arm 630 forms a J-hook 631. The J-hook 631 is adapted to catch and lift a grate covering an inlet. FIG. 6B illustrates a lifting tool 600 with two lifting arms 640. One end of the lifting arm 640 is adapted to receive the connector 621, while the other end of the lifting arm 640 forms a lift handle receiver 641. The lift handle receiver 641 is adapted to fit a lift handle or rail on an inlet filter frame for the purpose of lifting an inlet filter system out of an inlet.

FIG. 6C illustrates a configurable lifting tool 600 according to an embodiment of the invention. The configurable lifting tool 600 comprises a lifting bar 610, eye bolts 620, connectors 621, and one or more lifting bars. FIG. 6C illustrates a lifting tool 600 with two lifting arms 630. One end of the lifting arm 630 is adapted to receive the connector 621, while the other end of the lifting arm 630 forms a right angle hook 632. As shown in FIG. 6C, the right angle hook 632 is formed with two approximately 90 degree angles. The right angle hook 632 is adapted to catch and lift a grate covering an inlet.

The different interchangeable lifting arms are clipped onto the lifting bar eye bolts 620. The lifting arms are capable of rotating and swinging on the eye bolts at any orientation so they can grab the cross corner lift handles on any square or rectangular spread and the parallel lift rails on circular designs. The grate lifting is critical for installation and maintenance of inlet filters. The configurable lifting tool 600 provides several advantages over previous systems. The configurable lifting tool 600 may be used by one or more users to lift any grate up with two J-hooks 631 instead of a traditional grate puller such as a crow bar with a hook at the end. Rather than a user dragging a grate off an inlet casting with a puller, a user can lift a grate up and off an inlet with the configurable lifting tool 600. Heavy rectangular grates often end up falling into the inlet when being pulled off with the traditional pullers.

Figure 7:
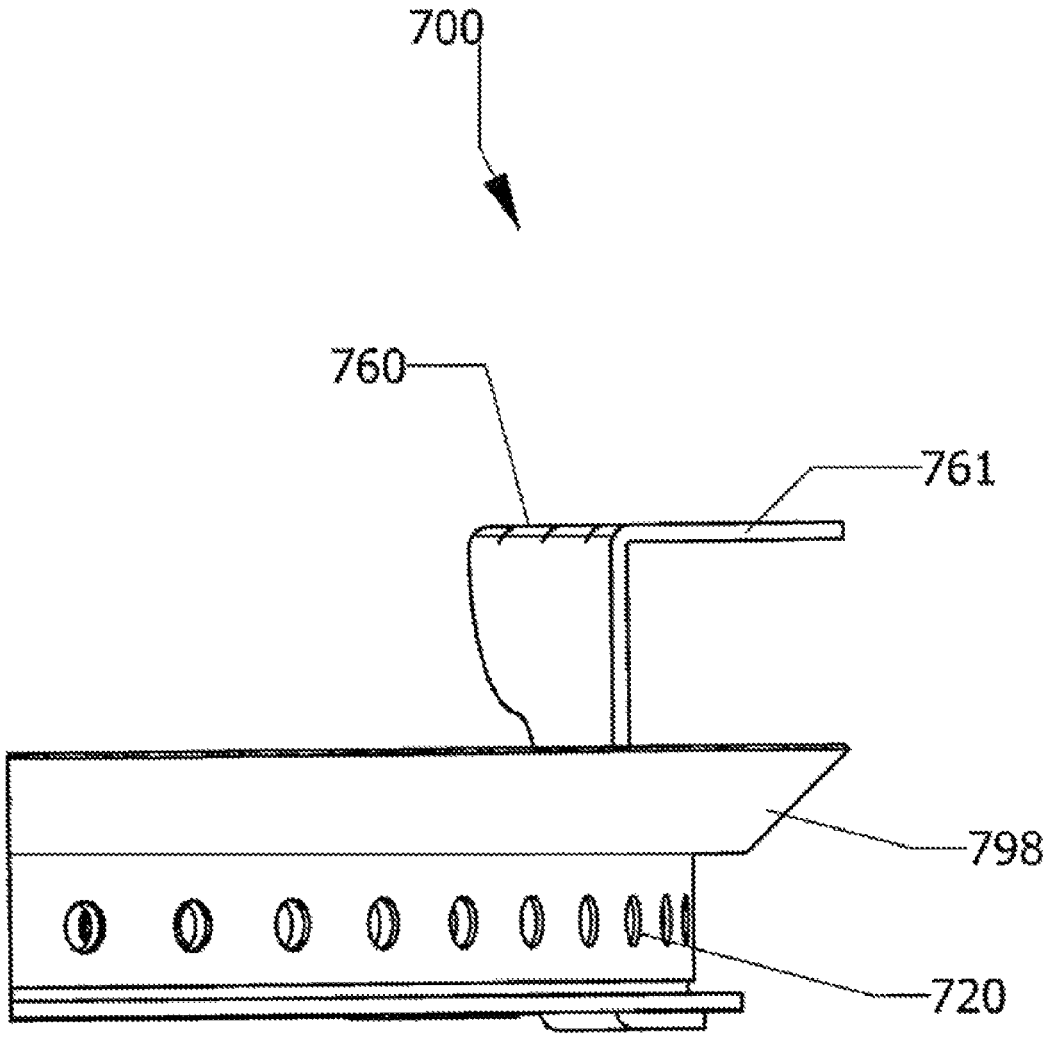
FIG. 7 illustrates an improved circular configurable inlet filter protection system according to an embodiment of the invention.

FIG. 7 illustrates an improved circular configurable inlet filter protection system 700 according to an embodiment of the invention. The circular configurable inlet filter protection system 700 comprises circular channel 720, circular bracket 760, and runoff flange 798. As described elsewhere in this application, the circular bracket 760 may be comprised of one or more rigid materials, for example steel. The circular bracket 760 includes hanger 761 and hanger support structure 768.

The runoff flange 798 is designed to catch runoff water from a circular configurable inlet filter framing system 700 with overflow protection. As shown in FIG. 7, the circular configurable inlet filter framing system 700 includes hanger 761 which rests on the load bearing lips of the inlet casting to support the circular configurable inlet filter framing system 700. The circular channel 720 which supports a sediment bag filter rests below grade at a distance approximately equal to the height of hanger support 768. The distance between the hanger 761 and the sediment bag allows for runoff water to overflow if the sediment bag is full. However, even when the sediment bag is not full the runoff may pass between the overflow openings, bypassing the sediment bag. In the improved circular configurable inlet filter framing system 700, a runoff flange 798 attaches to the circular channel 720 to prevent runoff from bypassing the sediment bag. In one embodiment of the invention, the runoff flange extends outward from the circular channel and slopes upward between a 30 and 45 degree angle. When runoff flows into the inlet, even if the runoff does not travel completely vertically downward, the runoff will be caught by the flange and funneled back down through the sediment bag. Other embodiments of the invention may incorporate other angles and orientations. The runoff flange 798 may be comprised of plastic or any other rigid material. In other embodiments, the runoff flange may be flexible to allow deformation while still retaining its basic shape. Additionally, the runoff flange 798 may be connected to the circular channel 720 with a screw, bolt, or other fastener.

Figure 8:
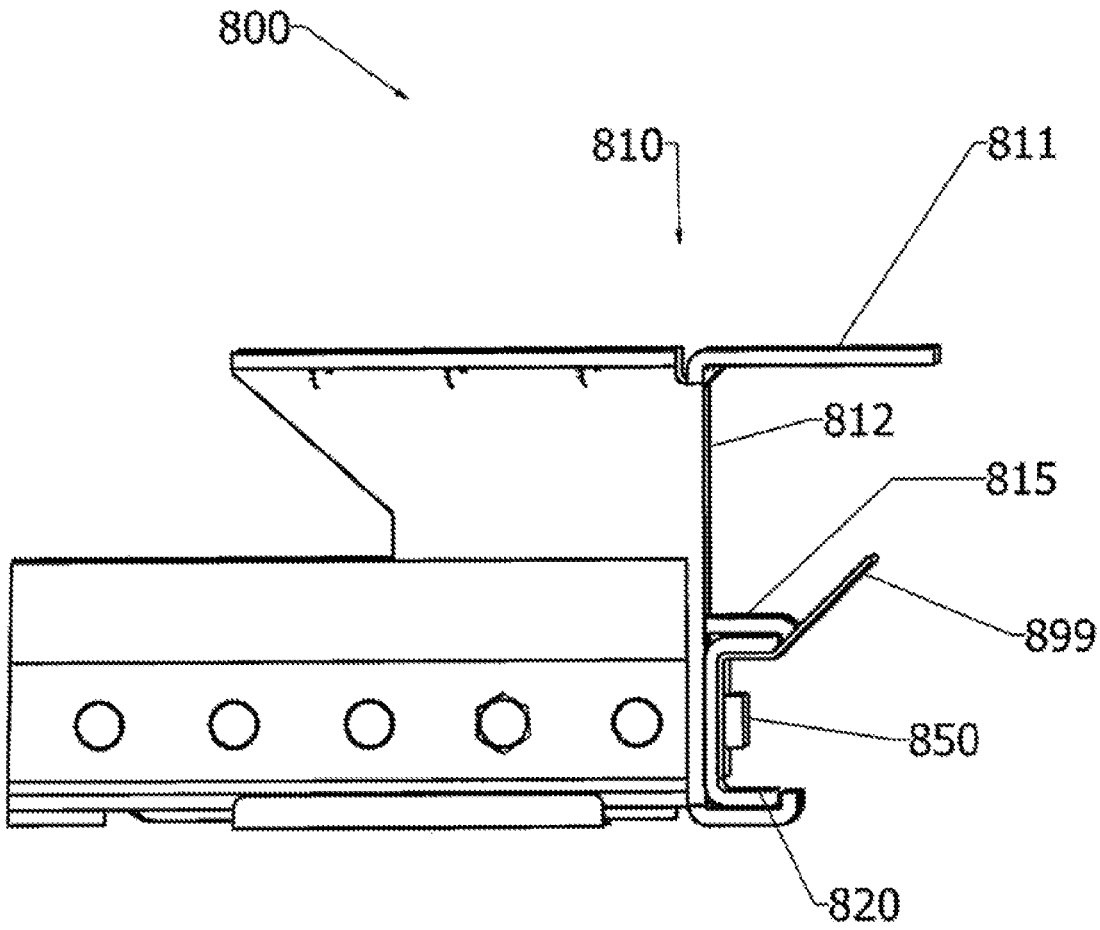
FIG. 8 illustrates an improved rectangular configurable inlet filter protection system according to an embodiment of the invention.

FIG. 8 illustrates an improved rectangular configurable inlet filter framing system 800 according to an embodiment of the invention. The rectangular configurable inlet filter framing system 800 comprises corner bracket 810, frame rail contact 815, frame rail 820, bolt 850, and runoff flange 899. Corner bracket 810 further includes hanger 811 and hanger support structure 812.

As described elsewhere in this application, the frame of the rectangular inlet filter framing system 800 is comprised by four frame rails 820 joined at four corner brackets 810. In some embodiments of the invention, the frame rails 820 and corner brackets 810 may be joined by bolts 850. Other embodiments of the invention may use other fasteners that allow for quick assembly and disassembly.

Similar to other embodiments of the invention, the hanger 811 contacts the edge of an inlet and supports the weight of the rectangular configurable inlet filter protection system 800. In some embodiments, a portion of the rectangular configurable inlet filter framing system 800 resides below grade. For inlet filters with overflow protection, there is a vertical gap between the hanger 811 and the frame rail 820 which connects to a sediment bag. When runoff travels below grade, it may not flow directly downward. Rather, the runoff may flow in vertical and horizontal directions. In some embodiments, the horizontal component of the runoff flow may cause runoff to travel through the gap between the hanger 811 and the frame rail 820, thus bypassing the sediment bag and causing unfiltered runoff to enter the storm sewer system. However, the embodiment illustrated in FIG. 8 contains a runoff flange 899 capable of catching runoff traveling through the vertical gap and funneling it back downward through the sediment bag. As shown in FIG. 8, the runoff flange 899 extends outward and upward from the frame of the inlet filter. In some embodiments, the runoff flange 899 is constructed of a rigid or semi-rigid material such as plastic. Other embodiments may utilize runoff flanges 899 constructed of any other material capable of catching and funneling water back through the sediment bag. In one embodiment of the invention, the runoff flange 899 may be bolted or screwed to the frame rail 820. Certain embodiments of the invention allow the runoff flange 899 to funnel water back to the sediment bag while still allowing for overflow when the sediment bag is full.

Figure 9A:
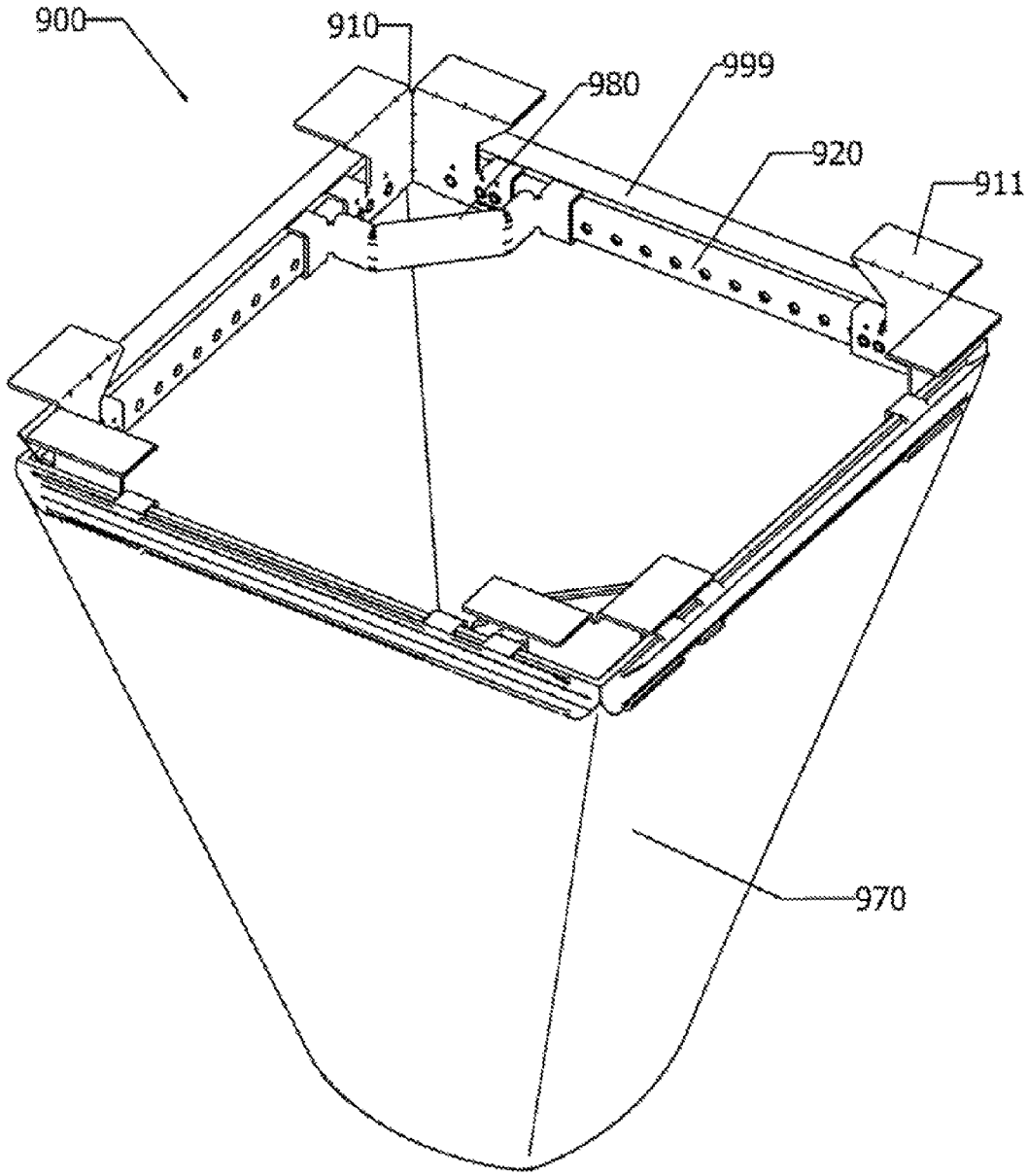
FIGS. 9A, 9B, and 9C illustrate several views of an improved rectangular configurable inlet filter protection system according to an embodiment of the invention.
Figure 9B:
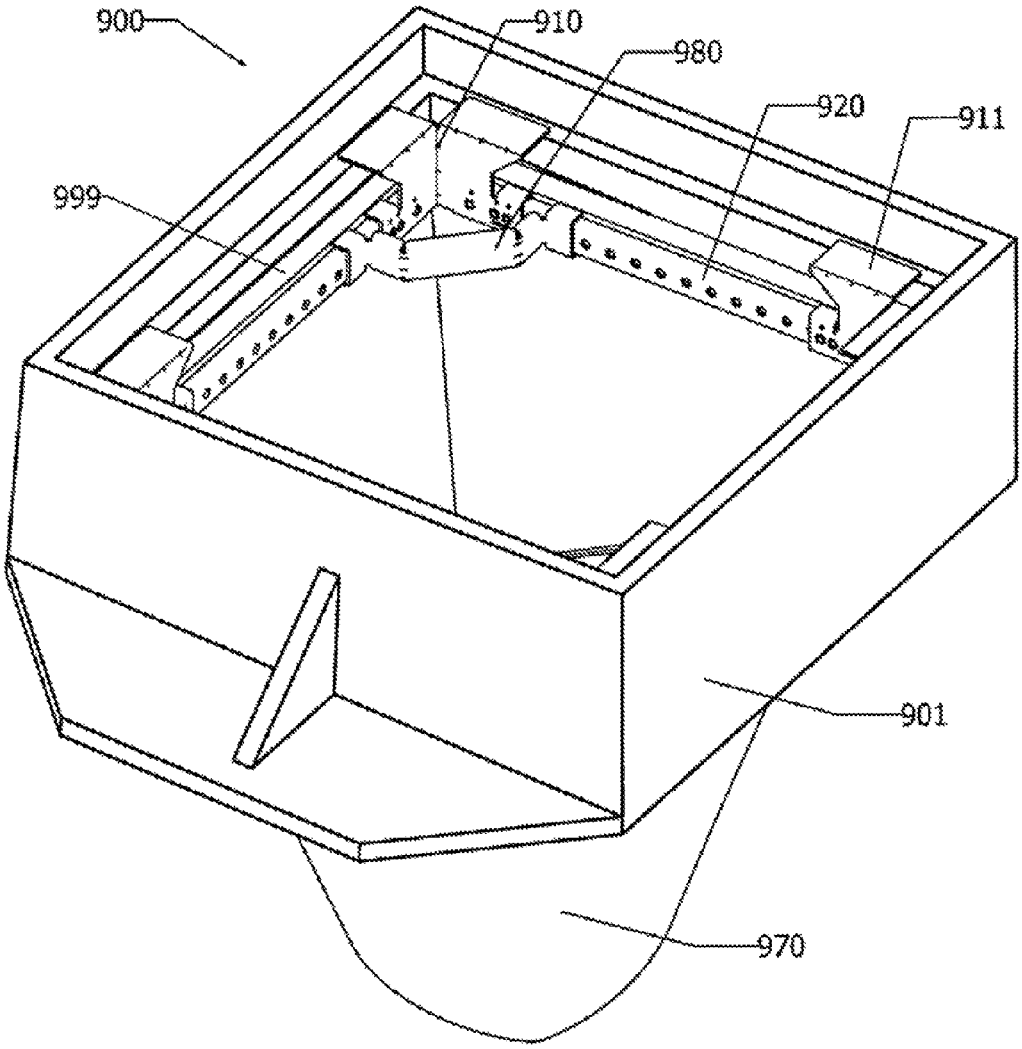
Figure 9C:
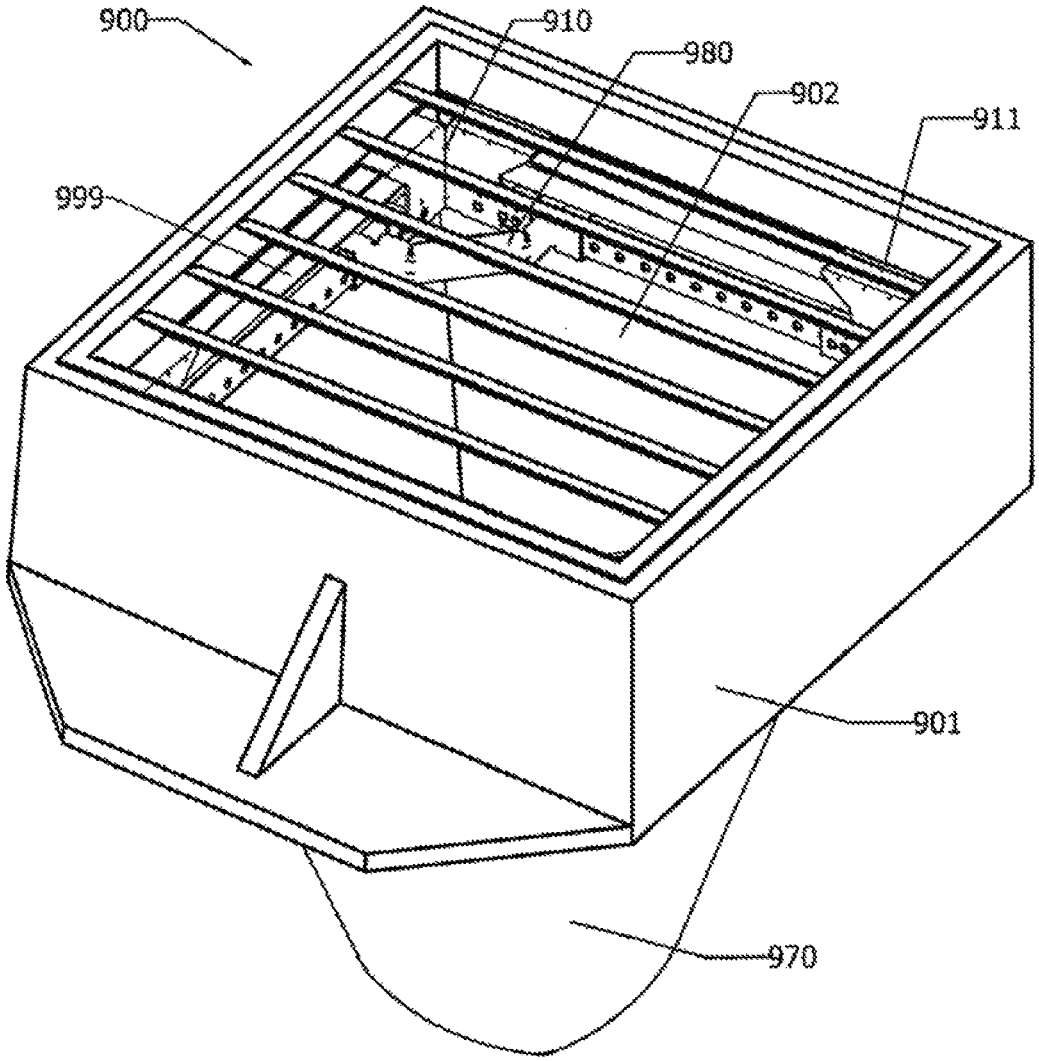

FIGS. 9A, 9B, and 9C illustrate several views of an improved rectangular configurable inlet filter protection system 900 according to an embodiment of the invention. FIG. 9A illustrates an improved rectangular configurable inlet filter protection system 900 with a corner bracket 910, frame rail 920, sediment bag 970, lifting bracket 980, and runoff flange 999. Similar to other embodiments, the rectangular frame is formed by connected frame rails 920 to corner brackets 910. The hangers 911 of the corner brackets 910 support the weight of the rectangular frame as it rests below grade by contacting an inlet edge surface. The lifting brackets 980 can be used to lift the inlet filter system out of the inlet with a tool such as the configurable lifting tool described elsewhere in this application. The sediment bag 970 is designed to filter the runoff water. The runoff flange 899 is capable of funneling water back to the sediment bag 970.

FIG. 9B illustrates the improved rectangular configurable inlet filter protection system 900 of FIG. 9A placed in an inlet 901. As shown in FIG. 9B, the hanger 911 rests upon an inlet 901 surface while the rest of the frame is below inlet 901 grade. Further, runoff flange 999 is adapted to prevent runoff from bypassing the sediment bag 970. FIG. 9C illustrates the addition of an inlet grate 902 placed upon the inlet 901 opening. The inlet grate 902 may be capable of preventing large objects, such as a person from falling into the inlet 901 opening. In some embodiments the inlet 901 and inlet grate 902 are made of a rigid material such as metal.

Figure 10:
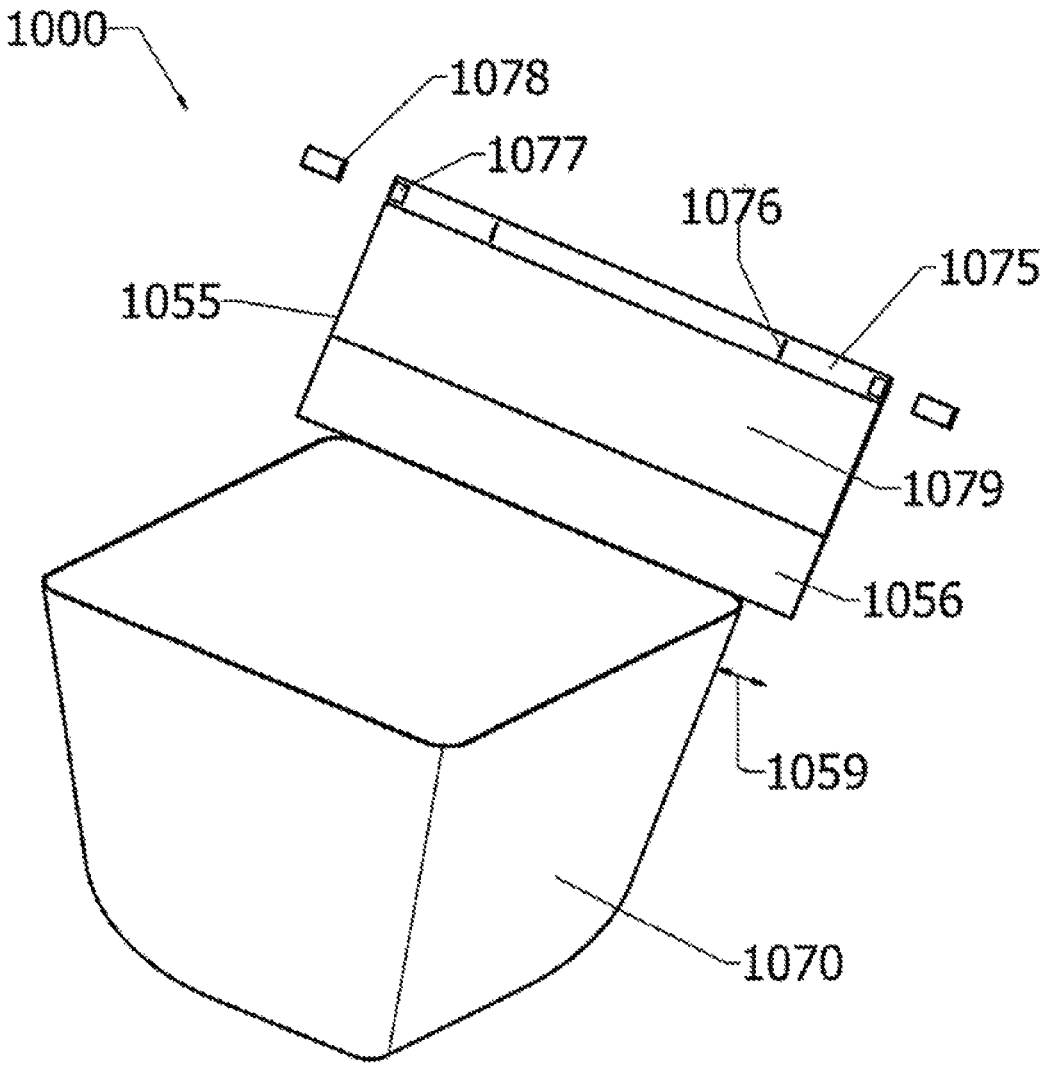
FIG. 10 illustrates a sediment bag with a securing mechanism for use in a drainage filter protection system according to an embodiment of the invention.

FIG. 10 illustrates a sediment bag with a securing mechanism 1000 for use in a drainage structure filter protection system according to an embodiment of the invention. The sediment bag 1070 described in one embodiment may be similar to other embodiments of sediment bags described in this application. For example, the sediment bag 1070 may possess similar properties with the sediment bag 370. The sediment bag 1070 may be comprised an inner and outer layer and is designed to limit and/or prevent pollution from entering a drainage inlet. In a preferred embodiment, the inner layer is a geotextile fabric filter with a typical flow rate between 140 and 200 gpm/sq yd. The inner layer filter may be either woven or non-woven. The outer layer is preferably a flexible polyester mesh weighing at least 4 oz/sq yd. The outer layer may reinforce the inner layer. Additionally the outer layer 372 may include bright colors, such as orange, to signal the presence of an inlet protection device.

As shown in FIG. 10, the sediment bag 1070 has a curb guard flap 1055 adapted for use with an inlet having a curbed portion. The curb guard flap 1055 covers the curbed portion of an inlet to filter runoff entering the curb inlet. Like other components of the sediment bag 1070, the curb guard flap 1055 may be comprised of an inner and outer layer of material. Alternatively, the curb guard flap may be a single layer of material. Additionally, the curb guard flap 1055 includes components designed to secure the curb guard flap in place. For example, the curb guard flap 1055 includes magnet pockets 1075. The magnet pockets 1075 are adapted to hold a magnet 1078. The magnet 1078 is attracted to the metal of the curb inlet and secures the curb guard flap 1055 to a surface, i.e. the top, of the curb inlet. The magnet may be a rare earth magnet, or any other type of magnet. The magnet pocket 1075 may be any size and hold any size magnet, but in one embodiment, the magnet pocket 1075 is approximately 8 inches long. One end of the magnet pocket 1075 is shared with the edge of the curb guard flap 1055 while the other end of the magnet pocket 1075 is formed by stitching 1076. Additionally, the edge of the magnet pocket 1075 shared with the edge of curb guard flap 1075 is secured with fastener 1077. Fastener 1077 may be any type of fastener. In one embodiment of the invention, the fastener 1077 is a hook and loop type fastener such as Velcro. Other embodiments may use snaps, buttons, or any other reusable fastener. Alternatively, the fastener 1077 may be stitching or some other non-reusable fastener. In operation, a user may slide a magnet 1078 into magnet pocket 1075, attach the Velcro fastener 1077 and place the magnet pocket 1075 into contact with a metal surface of an inlet.

The curb guard flap 1055 may include other components adapted to secure the curb guard flap 1055 in position over a curb inlet. For example as shown in FIG. 10, the curb guard flap 1055 includes a weight pocket 1079. In one embodiment weight pocket 1079 is a two-ply segment, with an approximately nine inch wide opening at both ends of curb guard flap 1055. In operation, a user may place a weight into weight pocket 1079. Weight pocket 1079, including the added weight would rest on a surface, i.e. the top, of an inlet in order to secure the curb guard flap 1055 over the inlet opening in order to filter runoff. Like the magnet 1078, the weight may prevent the curb guard flap 1055 from being moved out of position which would limit the effectiveness of the curb guard flap 1055. In one embodiment of the invention, the weight may be a 2 inch by 4 inch section of board. In other embodiments, the weight may be a rock sack or sand bag.

As shown in FIG. 10, curb guard flap 1055 includes curb filter 1056. Curb filter 1056 is the portion of curb guard flap 1055 that covers the curb inlet opening and comes into contact with runoff flow. The curb filter 1056 may be similar in composition and functionality to the below grade portion of sediment bag 370 that comes into contact with runoff flow. For example, curb filter 1056 may be comprised of an inner and outer layer like the inner and outer layers of sediment bag 370. In one embodiment, the curb filter 1056 may be approximately five and half inches high. Other embodiments of the invention provide for a curb filter 1056 with a height capable of covering the height of the curb inlet. Additionally, as shown in FIG. 10, the curb filter 1056 may extend wider than the rest of sediment bag 1070. In one embodiment, each side of the curb filter 1056 extends three inches wider than the rest of the sediment bag 1070. The sediment bag 1070 with a curb guard flap 1055 adapted for use with an inlet having a curbed portion may include alternative embodiments with other dimensions. Additionally, the embodiments of the invention may be used with rolled or non-rolled curbs.

FIGS. 11A, 11B, 11C, and 11D illustrate a configurable lifting tool 1100 according to an embodiment of the invention. The configurable lifting tool 1100 comprises a lifting bar 1110, eye bolts 1120, connectors 1121, and one or more lifting arms.

Figure 11A:
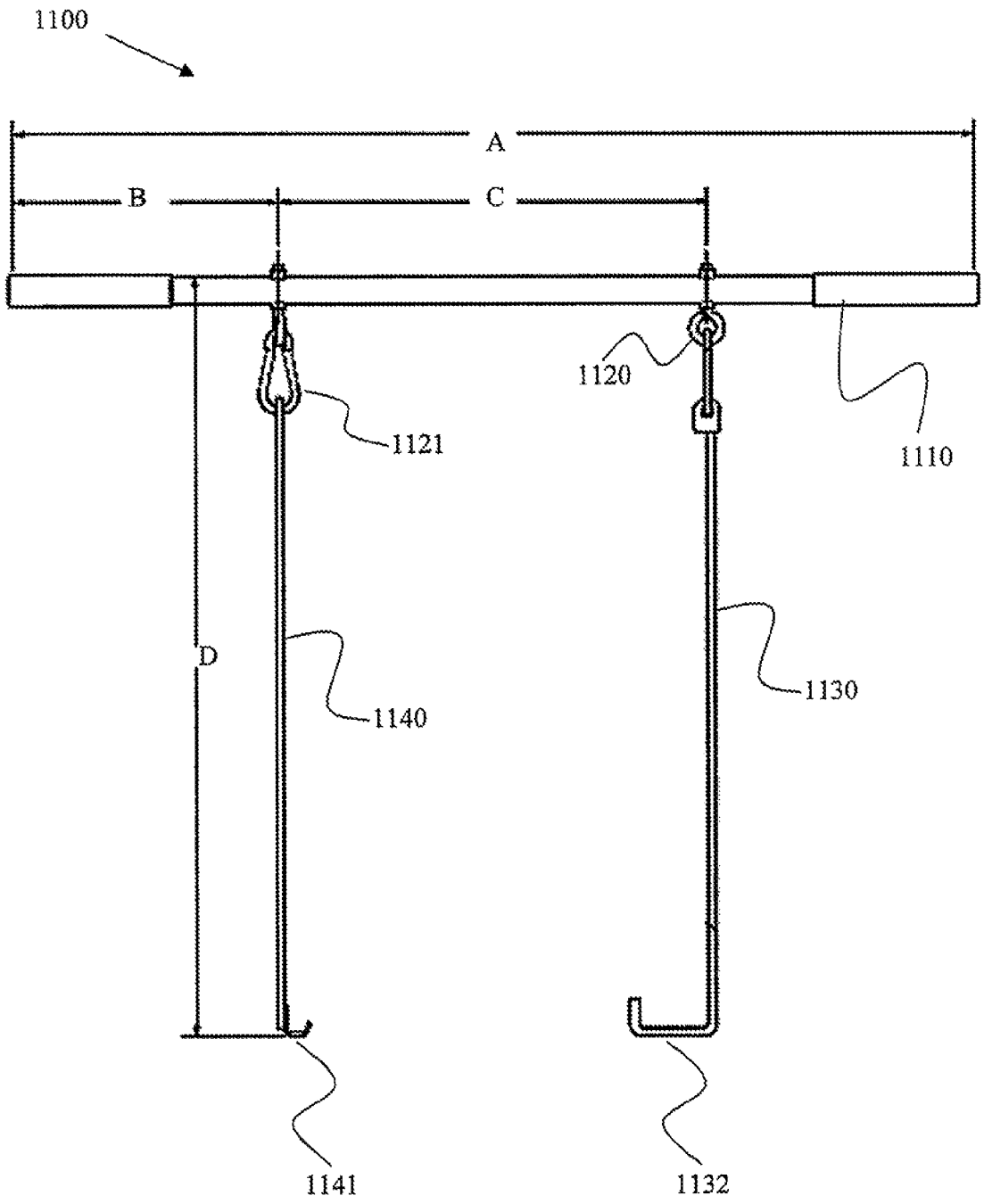
FIGS. 11A, 11B, 11C, and 11D illustrate a configurable lifting tool according to an embodiment of the invention.

FIG. 11A illustrates a lifting tool 1100 with lifting arm 1130 and lifting arm 1140. One end of the lifting arm 1130 is adapted to receive the connector 1121, while the other end of the lifting arm 1130 forms a right angle hook 1132. The right angle hook 1132 is adapted to catch and lift a grate covering an inlet. In one embodiment of the invention, the distance from end to end of the lifting bar 1110, as indicated by A, measures 36 inches. Further, the distance from one end of the lifting bar 1110 to the closest eye bolt 1120, as indicated by B, measures 10 inches. The distance between eye bolts, as indicated by C, measures 16 inches. The height of the lifting tool, as measured from the top of the lifting bar 1110 to the bottom of the lift handle receiver 1141 and indicated by D, measures approximately 28.53 inches. In alternative embodiments, the length of the lifting arm may vary. For example, the lifting arm 1130 could have a length of 20 inches instead of 24. As a result, the height of the lifting tool, as measured by D, would measure approximately 24.53 inches. The lifting arm 1130 could be any height effective to lift a grate and/or an inlet out of drainage structure.

Figure 11B:
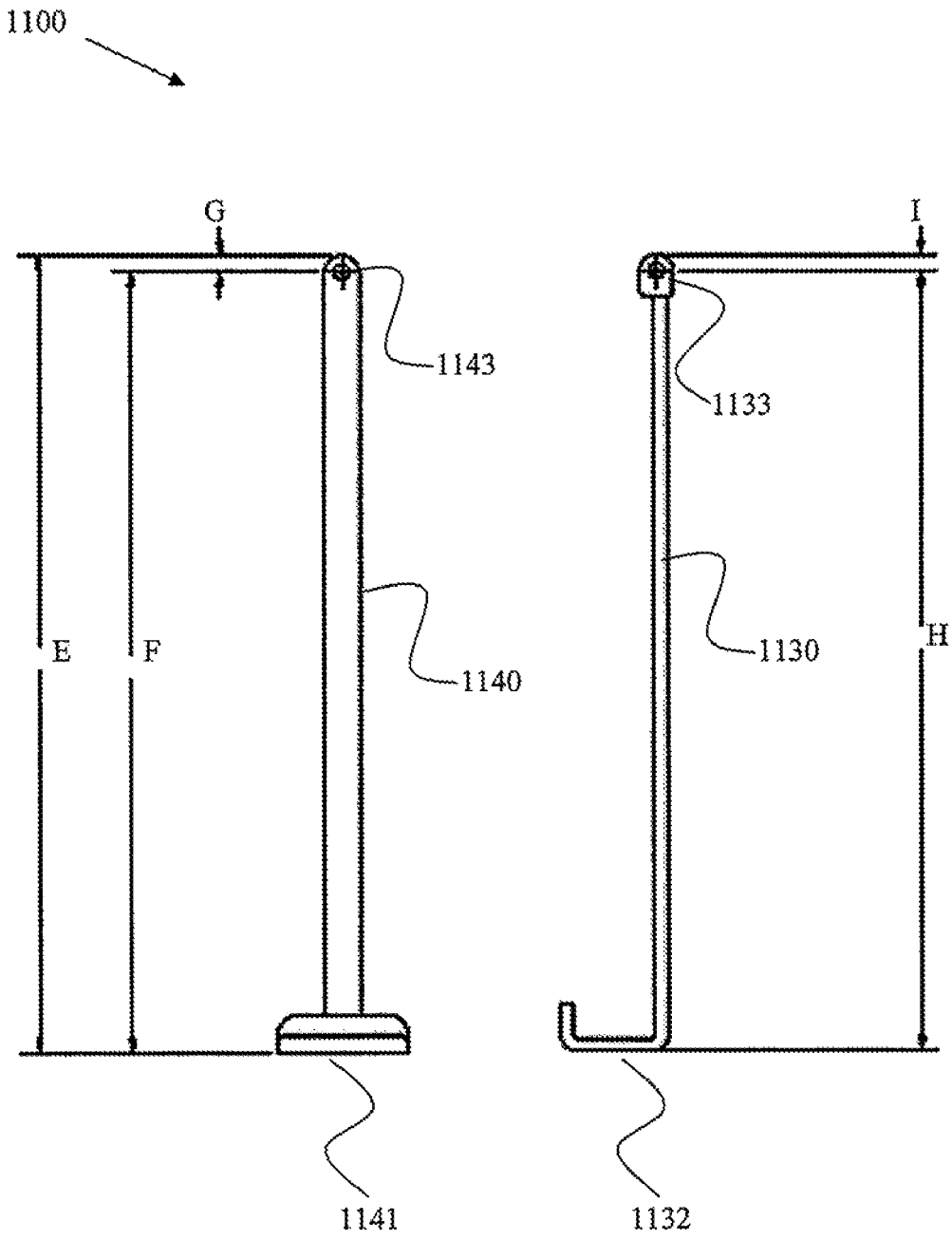

FIG. 11B illustrates further views of the lifting arms 1130 and 1140. As shown in FIG. 11B by E, the height of lifting arm 1140 measures 24 inches. Further the distance between the top of lifting arm 1140 and the attachment point 1143, as indicated by G, measures 0.5 inches. The distance between the bottom of the lifting arm 1140 and the attachment point 1143, as indicated by F, measures 23.5 inches. Similarly, the distance between the top of lifting arm 1130 and the attachment point 1133, as indicated by I, measures 0.5 inches. The distance between the bottom of the lifting arm 1130 and the attachment point 1133, as indicated by H, measures 23.5 inches. The attachment points 1133 and 1143 may be a hole or opening adapted to receive connector 1121. In some embodiments, connector 1121 may be a carabineer style clip or any other fastener. In alternative embodiments, the length of the lifting arm may vary. For example, the lifting arm 1130 could have a length of 20 inches instead of 24. As a result, the distance between the bottom of the lifting arm 1130 and the attachment point 1133, as indicated by H, measures 19.5 inches.

Figure 11C:
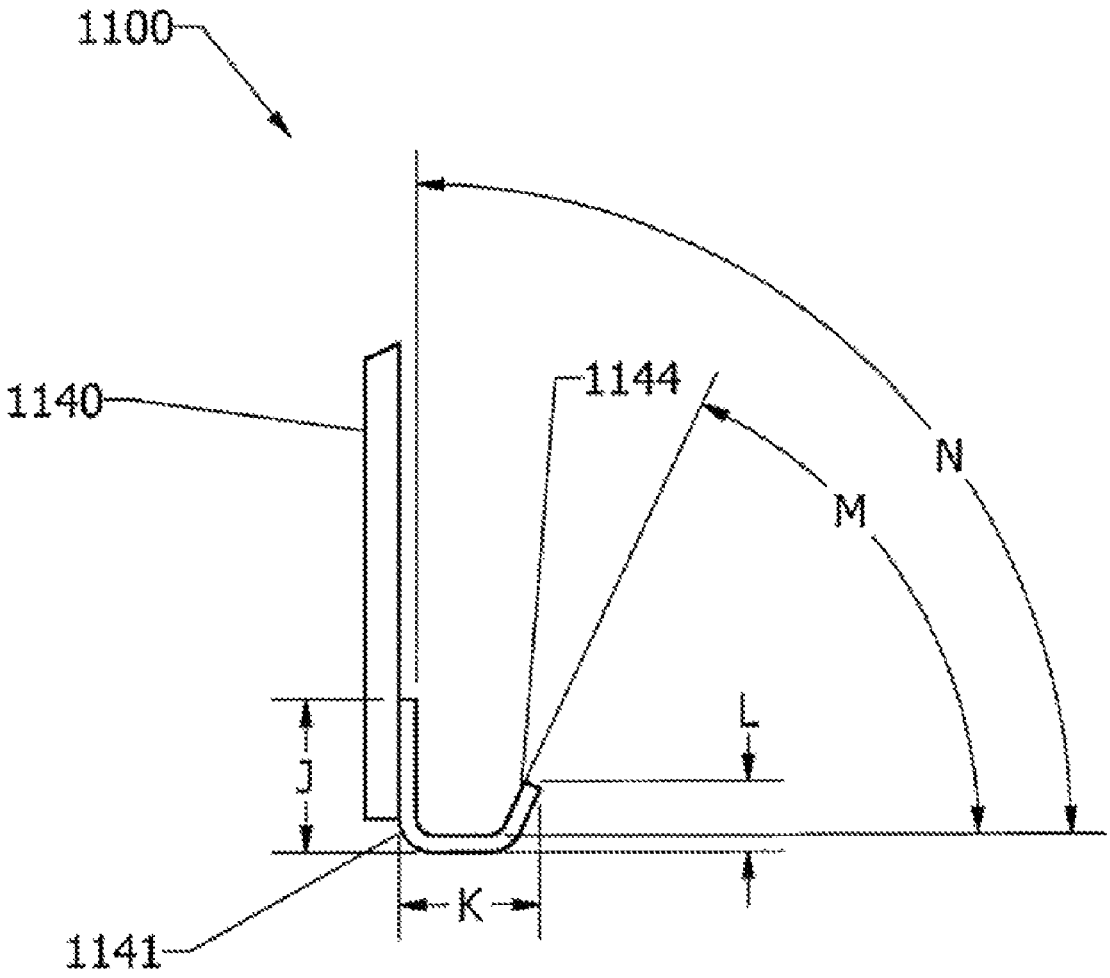

FIG. 11C illustrates an additional view of lift handle receiver 1141, which is adapted to fit a lift handle or rail on an inlet filter frame for the purpose of lifting an inlet filter system out of an inlet. As shown in FIG. 11C, the lift handle receiver 1141 contacts lifting arm 1140. In some embodiments, the lift handle receiver 1141 may be welded to lifting arm 1140. The height of lift handle receiver 1141 as indicated by J, measures approximately 2.26 inches. The lift handle receiver 1141 includes an angle, as indicated by N, of 90 degrees. The depth of lift handle receiver 1141, as indicated by K, measures approximately 2.06 inches. The lift handle receive 1141 includes a lip 1144 formed at an angle indicated by M, of 65 degrees. The height of the lip 1144 as indicated by L, measures approximately 1.04 inches.

Figure 11D:
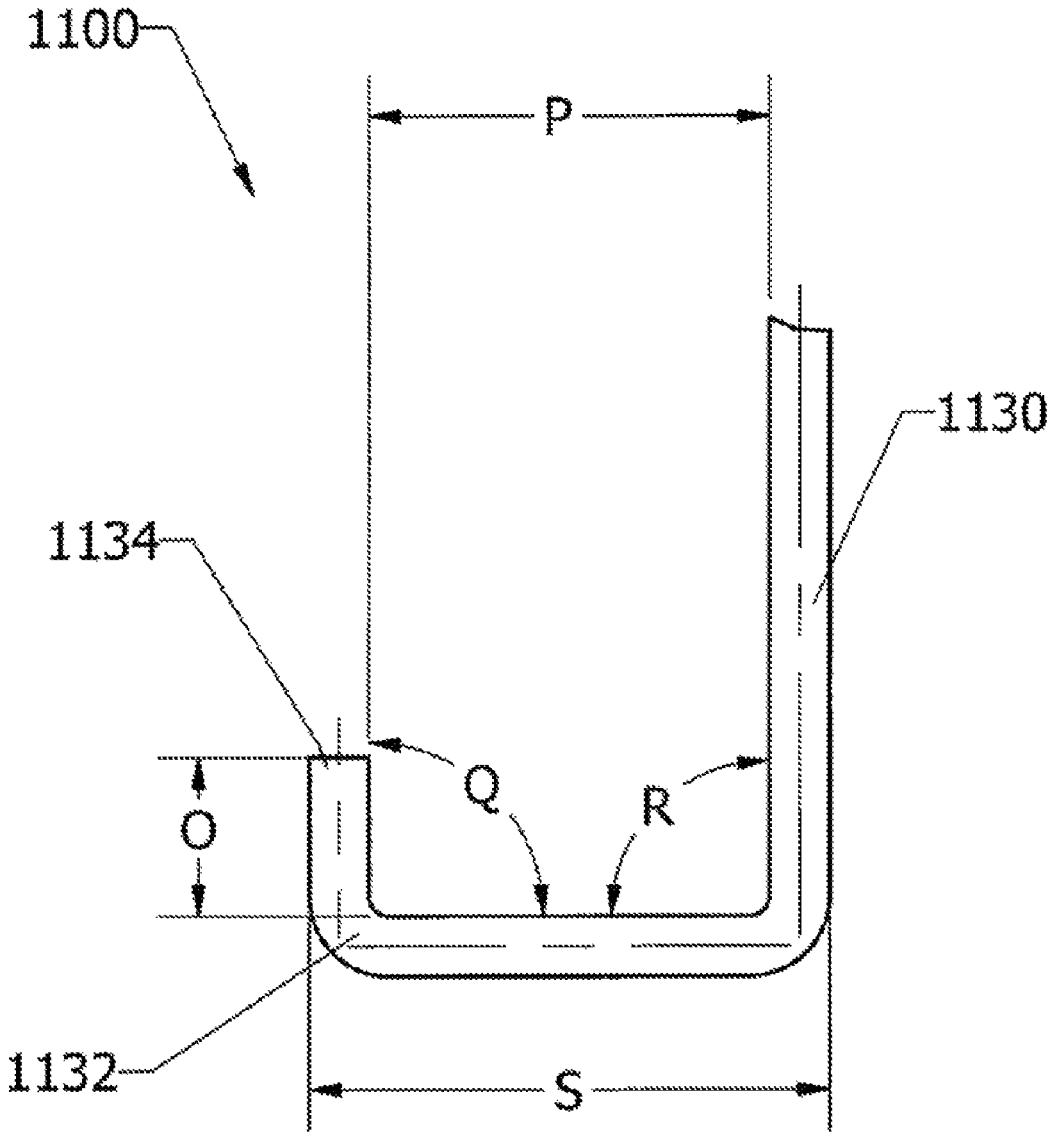

FIG. 11D illustrates an additional view of right angle hook 1132, which is adapted to fit a grate covering an inlet casting for the purpose of lifting a grate out of an inlet. As shown in FIG. 11D, the right angle hook 1132 may be a component of lifting arm 1130. Alternatively, in some embodiments, the right angle hook 1132 may be attached to lifting arm 1130.

The right angle hook 1132 includes two angles, as indicated by Q and R, of 90 degrees. The outer depth of right angle hook 1132, as indicated by S, measures approximately 7.5 inches. The inner depth of right angle hook 1132, as indicated by P, measures approximately 5 inches. The right angle hook 1132 includes a lip 1134. The height of the lip 1134 as indicated by O, measures approximately 2 inches.

The different interchangeable lifting arms are clipped onto the lifting bar eye bolts 1120. The lifting arms are capable of rotating and swinging on the eye bolts at any orientation so they can grab the cross corner lift handles on any square or rectangular spread and the parallel lift rails on circular designs. The grate lifting is critical for installation and maintenance of inlet filters. The lifting tool 1100 is not limited to the above disclosed dimensions and may incorporate components of varying sizes. An alternative embodiment of the interchangeable lifting arms provides for lifting arms with a height of approximately 20 inches. A lifting arm of 20 inches rather than 24 inches may alter some or all of the measurements disclosed in the discussion of FIGS. 11A-11D. Other embodiments of the invention are capable of working with any length lifting arm effective to lift grates and/or inlet filter framing systems.

This inexpensive system will replace the welded framework required on current Inlet Filters and offer more versatility to fit the wide array of drainage structures throughout the United States. As did the previous welded device, this frame is designed to drop into the casting opening and hang suspended on the load bearing lips of the casting beneath the drainage grate. Additionally, the inlet filter may be inserted directly into a pre-cast opening of a concrete drainage structure.

Both round and rectangular designs feature 2 lift handles at various spacing widths. Some rectangular designs with longer spans may incorporate 2 lifting rails in parallel and centered along the width, spaced 14"-16" apart.

Other, smaller rectangular frames feature 2 convenient corner lift handles located at opposite ends and corners. The lift handles add structural reinforcement and allow for easy removal with our universal maintenance tool in any framework. The maintenance tool is a proprietary design which incorporates grate lifting hooks, thus serving 2 purposes: 1. to remove the grate easily with up to 2 people, and 2. to quickly and efficiently remove and maintain the inlet filter frame and sediment bag assembly.

Testing has shown the combination of 1/−20 bolts with our extruded stamped holes carry a strip torque of 360 in-lbs and holding (backoff) torque of 200 in-lbs on average. Single and double hangers along with universal corner brackets are offered for different rectangular shaped castings depending on available load bearing surfaces and/or grate contours. The unique design feature of this system is the hanger hook concept. These are permanently fixed on some corners, but may also be angularly rotated and positioned at various heights creating a perfect fit for rolled curb, concave, and gutter style storm castings using the universal corners. This is not possible with other "adjustable" rigid framing technology, which are designed for basic flat round or rectangular grates.

The FLeXstorm™ Inlet Filter System will allow contractors to make adjustments as needed in the field. Once a job is complete the contractor can take the re-usable filter frame to the next jobsite requirement and equip it with a new sediment bag using only a screwdriver. Contractors may also break down the components and re-assemble into a completely different model by ordering new or modifying the existing channel lengths. Parts breakdowns and assembly instructions for each inlet filter requirement are easy to follow with corner bracket holes labeled A, B, C and channel holes labeled 1, 2, 3. All steel components are corrosion resistant (zinc plated) and stamped with the FLeXstorm™ part numbers.

The FLeXstorm™ Inlet Filter System provides several advantages over types of inlet protection devices. First, the FLeXstorm™ Inlet Filter System sits below grade and may include an overflow bypass to prevent standing water forming at the inlet. The FLeXstorm™ Inlet Filter System is easily adjustable at the jobsite by simply moving bolts and/or swapping individual components of the configurable system. The sediment bag is also designed to be easily replaceable. The stamped steel construction of the FLeXstorm™ Inlet Filter System provides several advantages over cast or welded inlet devices such as lighter weight, cheaper material cost, and drastically reduced installation times. Additionally, FLeXstorm™ Inlet Filter System is corrosion resistant. The lifting tool is adapted to remove all types of FLeXstorm™ Inlet Filter System devices as well as inlet grates. Further, the FLeXstorm™ Inlet Filter System will fit non-traditional inlets, such as castings with contours, concave or rolled curb profiles, and inlets with a limited flange area. The magnetic curb guard is simple and efficient to utilize. It allows for easy securing of the curb guard where the curb box opening is surrounded by concrete and does not require stakes or heavy items to secure. Additionally, the magnetic curb guard allows for breakaway in case of contact with a street sweeper without damaging the curb guard or inlet protection frame. Finally, the FLeXstorm™ Inlet Filter System provides for several advantages over bag-only inlet protectors. Unlike a bag-only protector which requires an inlet grate to be removed along with the full sediment bag when emptying the sediment bag the FLeXstorm™ allows for the removal of the sediment bag with a lightweight inlet protection frame. Removing a grate or inlet basin with a full sediment bag attached often requires machine assistance and multiple laborers. A FLeXstorm™ Inlet Filter System may be easily removed and installed with just one laborer.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. An apparatus for use in a drainage filtering system comprising:

a corner bracket including two surfaces adjoined at an angle to form a corner; and a frame rail contact arranged on a bottom portion of the corner bracket and configured to attach to a frame rail, the frame rail being attachable to a sediment bag; and a hanger configured to support the corner bracket by contacting an above grade surface of a drainage structure such that, when attached, the frame rail and the sediment bag are each below the grade surface of the drainage structure when the hanger contacts the above grade surface.

2. The apparatus of claim 1, wherein the corner bracket includes a hole configured to receive a fastener, and wherein the corner bracket is attachable to the frame rail using the hole and the fastener.

3. The apparatus of claim 1, further including an overflow gap comprising a vertical distance between the corner bracket and the hanger, wherein the overflow gap is configured to allow runoff to bypass the sediment bag attached to the frame rail by allowing the runoff to flow over the frame rail and below the hanger.

4. The apparatus of claim 1, wherein the hanger is adjustable relative to at least one of the surfaces of the corner bracket, thereby providing for rotation of the hanger relative to the corner bracket to accommodate the hanger contacting the above grade surface of the drainage structure.

5. An apparatus for use in a drainage filtering system comprising:

a bracket including a frame rail contact arranged on a bottom portion of the bracket, wherein the frame rail contact is attachable to a frame rail, wherein the frame rail is attachable to a sediment bag, and wherein the frame rail is curved; and a hanger configured to support the bracket by contacting an above grade surface of a drainage structure such that, when attached, the frame rail and the sediment bag are each below the grade surface of the drainage structure when the hanger contacts the above grade surface.

6. The apparatus of claim 5, wherein the bracket includes a hole configured to receive a fastener, and wherein the bracket is attachable to the frame rail using the hole and the fastener.

7. The apparatus of claim 5 further including, an overflow gap comprising a vertical distance between the bracket and the hanger, wherein the overflow gap is configured to allow runoff to bypass the sediment bag attached to the frame rail by allowing the runoff to flow over the frame rail and below the hanger.

8. The apparatus of claim 5, wherein the hanger is adjustable relative to the bracket, thereby providing for rotation of the hanger relative to the bracket to accommodate the hanger contacting the above grade surface of the drainage structure.

9. An apparatus for use in a drainage filtering system comprising:

a corner bracket including a frame rail contact arranged on a bottom portion of the corner bracket, wherein the frame rail contact is attachable to a frame rail that is attachable to a sediment bag, wherein the corner bracket comprises two planar surfaces of a rigid material joined at a 90 degree angle, and wherein the planar surfaces include a first plurality of holes; a hanger support structure configured to support the corner bracket, wherein the hanger support structure includes a second plurality of holes; and a hanger connected to the hanger support structure, wherein the hanger is adapted to contact an above grade surface of a drainage structure such that, when attached, the frame rail and the sediment bag are each completely below the grade surface of the drainage structure when the hanger contacts the above grade surface.

10. The apparatus of claim 9, wherein the hanger support structure is connected to the corner bracket by a fastener through the first plurality of holes and the second plurality of holes.

11. The apparatus of claim 9, wherein the vertical height of the hanger support structure is capable of being adjusted by changing the position of the fastener with respect to the first plurality of holes and the second plurality of holes.

12. The apparatus of claim 9 wherein the orientation of the hanger support structure is capable of being adjusted to contact a surface of a curb by changing the position of the fastener with respect to the first plurality of holes and the second plurality of holes.

13. A method of employing an apparatus for use in a drainage filtering system, the method comprising:

attaching a frame rail to a bracket, the frame rail being attachable to a sediment bag, the apparatus comprising:

a bracket including a frame rail contact arranged on a bottom portion of the bracket, wherein the frame rail contact is attachable to the frame rail, and a hanger configured to support the bracket by contacting an above grade surface of a drainage structure such that, when attached, the frame rail and the sediment bag are each completely below the grade of the drainage structure when the hanger contacts the above grade surface.

14. The method of claim 13, wherein the bracket comprises a corner bracket including two surfaces adjoined at an angle, thereby forming a corner.

15. The method of claim 13, wherein the bracket is attachable to a curved frame rail.

16. The method of claim 13, wherein the bracket includes a hole configured to receive a fastener, and wherein the bracket is attachable to the frame rail using the hole and the fastener.

17. The method of claim 13, wherein the apparatus includes an overflow gap comprising a vertical distance between the bracket and the hanger, and wherein the overflow gap is configured to allow runoff to bypass the sediment bag attached to the frame rail by allowing the runoff to flow over the frame rail and below the hanger.

18. The method of claim 13, wherein the hanger is adjustable relative to the bracket, thereby providing for rotation of the hanger relative to the corner bracket to accommodate the hanger contacting the above grade surface of the drainage structure.

* * * * *